US005108864A

United States Patent [19]

Kato et al.

[11] Patent Number: 5,108,864

[45] Date of Patent: Apr. 28, 1992

[54] LIQUID DEVELOPER FOR ELECTROSTATIC PHOTOGRAPHY

[75] Inventors: Eiichi Kato; Hideyuki Hattori, both of Shizuoka, Japan

[73] Assignee: Fuji Photo Film Co., Ltd., Kanagawa, Japan

[21] Appl. No.: 603,482

[22] Filed: Oct. 26, 1990

[30] Foreign Application Priority Data

Oct. 27, 1989 [JP] Japan ..... 1-278733
Dec. 1, 1989 [JP] Japan ..... 1-310758
Dec. 11, 1989 [JP] Japan ..... 1-318959

[51] Int. Cl.[5] ..... G03G 9/12; G03G 11/00

[52] U.S. Cl. ..... 430/114; 430/115; 430/904

[58] Field of Search ..... 430/114, 115, 904

[56] References Cited

U.S. PATENT DOCUMENTS

| | | | |
|---|---|---|---|
| 4,837,102 | 6/1989 | Dan et al. | 430/114 |
| 4,840,865 | 6/1989 | Kato et al. | 430/114 |
| 4,842,975 | 6/1989 | Kato et al. | 430/137 |
| 4,873,166 | 10/1989 | Senga et al. | 430/137 |
| 4,977,055 | 12/1990 | Kato et al. | 430/114 |
| 4,983,486 | 1/1991 | Kato et al. | 430/115 |
| 5,035,971 | 7/1991 | Kato et al. | 430/114 |
| 5,043,241 | 8/1991 | Kato et al. | 430/114 |
| 5,049,468 | 9/1991 | Kato et al. | 430/115 |
| 5,055,369 | 10/1991 | Kato et al. | 430/114 |

*Primary Examiner*—Marion E. McCamish
*Assistant Examiner*—Rosemary Ashton
*Attorney, Agent, or Firm*—Sughrue, Mion, Zinn, Macpeak & Seas

[57] ABSTRACT

A liquid developer for electrostatic photography is disclosed. The liquid developer comprises resin grains dispersed in a non-aqueous solvent having an electric resistance of at least $10^9$ Ω cm and a dielectric constant of not higher than 3.5, wherein the dispersed resin grains asre copolymer resin grains obtained by polymerizing a solution containing at least one kind of a mono-functional monomer (A) which is soluble in the non-aqueous solvent but becomes insoluble in the non-aqueous solvent by being polymerized, in the presence of a dispersion-stabilizing resin which is soluble in the non-aqueous solvent and is a comb-like copolymer comprising at least (1) a mono-functional macromonomer (M) having a weight average molecular weight of from $1\times10^3$ to $2\times10^4$ and (2) a monomer represented by the general formula (III) described below, the mono-functional macromonomer (M) comprising at least one polymer component corresponding to a repeating unit represented by the general formula (IIa) or (IIb) described below and at least one polymer component containing at least one polar group selected from —COOH, $—PO_3H_2$, $—SO_3H$, —OH, wherein $R_1$ represents $—R_2$ or $-OR_2$ (wherein $R_2$ represents a hydrocarbon group)), —SH, a formyl group and an amino group, and the monofunctional macromonomer (M) having a polymerizable double bond group represented by the general formula (I) described below bonded to only one terminal of the main chain thereof;

(I)

wherein $X_0$ represents —COO—, —OCO—, $—CH_2OCO—$, $—CH_2COO—$, or —O—, $—SO_2—$, —CO—, wherein $R_{11}$ represents a hydrogen atom or a hydrocarbon group), and $a_1$ and $a_2$, which may be the same or different, each represents a hydrogen atom, a halogen atom, a cyano group, a hydrocarbon group, $—COO—Z_1$ or $—COO—Z_1$ bonded via a hydrocarbon group (wherein $Z_1$ represents a hydrogen atom or a hydrocarbon group);

(IIa)

(IIb)

wherein $X_1$ has the same meaning as $X_0$ in the general formula (I); $Q_1$ represents an aliphatic group having from 1 to 22 carbon atoms or an aromatic group having from 6 to 12 carbon atoms; $b_1$ and $b_2$, which may be the same or different, have the same meaning as $a_1$ and $a_2$ in the general formula (I); and V represents —CN, $—CONH_2$, or (wherein Y represents a hydrogen atom, a halogen atom, an alkoxy group or $—COOZ_2$ (wherein $Z_2$ repre- (Abstract continued on next page.)

sents an alkyl group, an aralkyl group, or an aryl group));

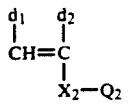

(III)

wherein $X_2$ has the same meaning as $X_0$ in the general formula (I); $Q_2$ has the same meaning as $Q_1$ in the general formula (IIa); and $d_1$ and $d_2$, which may be the same or different, have the same meaning as $a_1$ and $a_2$ in the general formula (I), with the proviso that, in the component of the mono-functional macromonomer (M) represented by the general formula (II) and in the component of the monomer represented by the general formula (III), at least one of $Q_1$ and $Q_2$ represents an aliphatic group having from 10 to 22 carbon atoms.

11 Claims, No Drawings

LIQUID DEVELOPER FOR ELECTROSTATIC PHOTOGRAPHY

FIELD OF THE INVENTION

The present invention relates to a liquid developer for electrostatic photography, which comprises resin grains dispersed in a liquid carrier having an electric resistance of at least $10^9$ Ω cm and a dielectric constant of not higher than 3.5, and more particularly to an electrostatic photographic liquid developer excellent in re-dispersibility, storability, stability, image-reproducibility, and fixability.

BACKGROUND OF THE INVENTION

In general, a liquid developer for electrostatic photography (electrophotography) is prepared by dispersing an inorganic or organic pigment or dye such as carbon black, nigrosine, or phthalocyanine blue, a natural or synthetic resin such as an alkyd resin, an acrylic resin, rosine, or synthetic rubber, in a liquid having a high electric insulating property and a low dielectric constant such as a petroleum aliphatic hydrocarbon, and further adding a polarity-controlling agent such as a metal soap, lecithin, linseed oil, a higher fatty acid, or a vinyl pyrrolidone-containing polymer, to the resulting dispersion.

In such a liquid developer, the resin is dispersed in the form of insoluble latex grains having a grain diameter of from several nm to several hundred nm. In a conventional liquid developer, however, the soluble dispersion-stabilizing resin and the polarity-controlling agent are insufficiently bonded to the insoluble latex grains, so that the soluble dispersion-stabilizing resin and the polarity-controlling agent become freely diffused in the liquid carrier with ease. Accordingly, there is a fault that when the liquid developer is stored for a long period of time or repeatedly used, the dispersion-stabilizing resin is split off from the insoluble latex grains, thereby the latex grains are precipitated, aggregated and accumulated, and the polarity thereof becomes indistinct. Also, since the latex grains once aggregated or accumulated are reluctant to re-disperse, the latex grains remain everywhere in a developing machine attached thereto, which results in causing stains of images formed and malfunction of the developing machine, such as clogging of a liquid feed pump.

In order to overcome such defects, a means of chemically bonding the soluble dispersion-stabilizing resin and the insoluble latex grains is disclosed in U.S. Pat. No. 3,990,980. However, the liquid developer disclosed therein is still insufficient although the dispersion stability of the grains to the spontaneous precipitation may be improved to some extent. When the liquid developer disclosed in U.S. Pat. No. 3,990,980 is actually used in a developing apparatus, these are some defects that the toner attached to parts of the developing apparatus is solidified in the form of coating, and the toner grains thus solidified are reluctant to re-disperse and are insufficient in re-dispersion stability for practical use, which causes the malfunction of the apparatus and staining of duplicated images.

In the method of producing resin grains described in the above described U.S. Pat. No. 3,990,980, there is a very severe restriction in the combination of a dispersion stabilizer being used and monomer(s) being insolubilized for producing monodispersed latex grains having a narrow grain size distribution. Mostly, the resin grains produced by the above described method are grains of a broad grain size distribution containing a large amount of coarse grains or poly-dispersed grains having two or more different mean grain sizes. In the above described method, it is difficult to obtain monodispersed resin grains having a narrow grain size distribution and having a desired mean grain size, and the method often results in forming large grains having a mean grain size of 1 μm or larger or very fine grains having a mean grain size of 0.1 μm or less. Furthermore, there is also a problem that the dispersion stabilizer being used must be prepared by an extremely complicated process requiring a long reaction time.

Further, for overcoming the above described defects, a method of improving the dispersibility, re-dispersibility and storage stability of resin grains by means of forming insoluble dispersed resin grains by copolymerizing a monomer being insolubilized and a monomer containing a long chain alkyl moiety or a monomer containing two or more polar moieties is disclosed in JP-A-60-179751 and JP-A-62-151868 (the term "JP-A" as used herein means an "unexamined published Japanese patent application").

Moreover, a method of improving the dispersibility, re-dispersibility and storage stability of resin grains by means of forming insoluble dispersed resin grains by copolymerizing a monomer being insolubilized and a monomer containing a long chain alkyl moiety in the presence of a polymer utilizing a difunctional monomer or a polymer utilizing a macro-molecular reaction is disclosed in JP-A-60-185963 and JP-A-61-63855.

Furthermore, a method of improving the dispersibility, re-dispersibility and storage stability of resin grains by means of forming insoluble dispersed resin grains by copolymerizing a monomer being insolubilized and a monomer containing two or more polar moieties in the presence of a polymer utilizing a difunctional monomer or a polymer utilizing a macro-molecular reaction is disclosed in JP-A-62-166362 and JP-A-63-66567.

On the other hand, recently a method of making a large number of prints such as 5,000 prints or more using a master plate for offset printing utilizing an electrophotographic system has been developed, and as a result of significant improvement of the master plate, it makes possible to obtain more than 10,000 prints of a large size. Also, a noticeable progress has been made in shortening the operation time in an electrophotomechanical system and an improvement of quickening a development-fixing steps in the system has been made.

Further, the rationalization of an electrophotomechanical system has been greatly required and, practically, it has been attempted to prolong a period for maintenance interval of a printing plate making machine. In the attempt, a liquid developer which can be used for a long period of time without being renewed has been required.

The dispersed resin grains produced by the methods as disclosed in the above described JP-A-60-17951, JP-A-60-185963, JP-A-61-63855, JP-A-62-151868, JP-A-62-166326 and JP-A-63-66567 yet show an unsatisfactory performance with respect to the dispersibility and re-dispersibility of the resin grains in the case of increasing the development speed or prolonging the period for maintenance interval, and with respect to the printing durability in the case of shortening the fixing time or using a master plate of a large size such as A-3 size or larger.

SUMMARY OF THE INVENTION

The present invention has been made for solving the above described problems inherent to conventional electrophotographic liquid developers.

An object of the present invention is to provide a liquid developer excellent in dispersion stability, re-dispersibility, and fixing property in an electrophotomechanical system wherein the development-fixing steps are quickened and a master plate of a large size is employed.

Another object of the present invention is to provide a liquid developer excellent in dispersion stability, re-dispersibility, and fixing property in an electrophotomechanical system wherein the development-fixing steps are quickened and the maintenance interval thereof is prolonged.

A further object of the present invention is to provide a liquid developer capable of forming an offset printing master plate having excellent receptivity for printing ink and printing durability by electrophotography.

A further object of the present invention is to provide a liquid developer suitable for various electrostatic photographies and various transfer systems in addition to the above described uses.

A still further object of the present invention is to provide a liquid developer capable of being used for any liquid developer-using systems such as ink jet recording, cathode ray tube recording, and recording by pressure variation or electrostatic variation.

Other objects of the present invention will become apparent from the following description and examples.

The above described objects of the present invention are accomplished by a liquid developer for electrostatic photography which comprises resin grains dispersed in a non-aqueous solvent having an electric resistance of at least $10^9$ Ω cm and a dielectric constant of not higher than 3.5, wherein the dispersed resin grains are copolymer resin grains obtained by polymerizing a solution containing at least one kind of a mono-functional monomer (A) which is soluble in the non-aqueous solvent but becomes insoluble in the non-aqueous solvent by being polymerized, in the presence of a dispersion-stabilizing resin which is soluble in the non-aqueous solvent and is a comb-like copolymer comprising at least (1) a mono-functional macromonomer (M) having a weight average molecular weight of from $1\times10^3$ to $2\times10^4$ and (2) a monomer represented by the general formula (III) described below, the mono-functional macromonomer (M) comprising at least one polymer component corresponding to a repeating unit represented by the general formula (IIa) or (IIb) described below and at least one polymer component containing at least one polar group selected from —COOH, $-PO_3H_2$, $-SO_3H$, —OH,

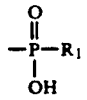

(wherein $R_1$ represents $-R_2$ or $-OR_2$ (wherein $R_2$ represents a hydrocarbon group)), —SH, a formyl group and an amino group, and the mono-functional macromonomer (M) having a polymerizable double bond group represented by the general formula (I) described below bonded to only one terminal of the main chain thereof;

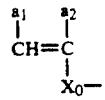

(I)

wherein $X_0$ represents —COO—, —OCO—, $-CH_2OCO-$, $-CH_2COO-$, or —O—, $-SO_2-$, —CO—,

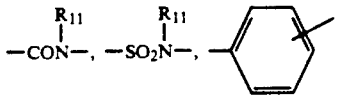

(wherein $R_{11}$ represents a hydrogen atom or a hydrocarbon group), and $a_1$ and $a_2$, which may e the same or different, each represents a hydrogen atom, a halogen atom, a cyano group, a hydrocarbon group, $-COO-Z_1$ or $-COO-Z_1$ bonded via a hydrocarbon group (wherein $Z_1$ represents a hydrogen atom or a hydrocarbon group);

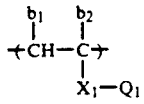

(IIa)

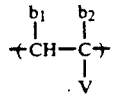

(IIb)

wherein $X_1$ has the same meaning as $X_0$ in the general formula (I); $Q_1$ represents an aliphatic group having from 1 to 22 carbon atoms or an aromatic group having from 6 to 12 carbon atoms; $b_1$ and $b_2$, which may be the same or different, have the same meaning as $a_1$ and $a_2$ in the general formula (I); and V represents —CN, $-CONH_2$, or

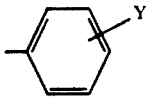

(wherein Y represents a hydrogen atom, a halogen atom, an alkoxy group or $-COOZ_2$ (wherein $Z_2$ represents an alkyl group, an aralkyl group, or an aryl group));

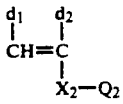

(III)

wherein $X_2$ has the same meaning as $X_0$ in the general formula (I); $Q_2$ has the same meaning as $Q_1$ in the general formula (IIa); and $d_1$ and $d_2$, which may be the same of different, have the same meaning as $a_1$ and $a_2$ in the general formula (I), with the proviso that, in the component of the mono-functional macromonomer (M) represented by the general formula (II) and in the component of the monomer represented by the general formula (III), at least one of $Q_1$ and $Q_2$ represents an aliphatic group having from 10 to 22 carbon atoms.

DETAILED DESCRIPTION OF THE INVENTION

It is preferred that the dispersion-stabilizing resin for use in the present invention is a comb-like copolymer having a weight average molecular weight of from $2\times10^4$ to $2\times10^5$ and having a polar group selected from $-PO_3H_2$, $-SO_3H$, $-COOH$, $-OH$, $-SH$,

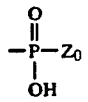

(wherein $Z_0$ represents $-Z_{10}$ or $-OZ_{10}$ (wherein $Z_{10}$ represents a hydrocarbon group)), a formyl group and an amino group bonded only one terminal of the polymer main chain.

Now, the liquid developer for electrostatic photography according to the present invention is described hereinafter in detail.

As the liquid carrier for the liquid developer of the present invention having an electric resistance of at least $10^9\ \Omega$ cm and a dielectric constant of not higher than 3.5, a straight chain or branched aliphatic hydrocarbon, an alicyclic hydrocarbon, an aromatic hydrocarbon, and a halogen-substituted compound thereof can be preferably used. Specific examples of the liquid carriers include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 solvent (Amsco: trade name of American Mineral Spirits Co.).

They may be used singly or as a combination thereof.

The non-aqueous dispersed resin grains (hereinafter, often referred to as "dispersion resin grains" or "latex grains") which are the most important constituting component in the liquid developer according to the present invention are resin grains produced by polymerizing (so-called polymerization granulation method) at least the above described mono-functional monomer (A) in a non-aqueous solvent in the presence of the dispersion-stabilizing resin which is the above described comb-like copolymer.

As the non-aqueous solvent in the above described polymerization, any solvents which are miscible with the above described liquid carrier for the liquid developer for electrostatic photography of the present invention can be basically used.

Specifically, the non-aqueous solvent used for the production of the dispersion resin grains can be any solvents which are miscible with the above described liquid carrier for the liquid developer, and such solvents preferably include straight chain or branched chain aliphatic hydrocarbons, alicyclic hydrocarbons, aromatic hydrocarbons, and halogen-substituted compounds thereof. Specific examples of such solvents are hexane, octane, isooctane, decane, isodecane, decalin, nonane, dodecane, isododecane, an isoparaffinic petroleum solvent such as Isopar E, Isopar G, Isopar H, Isopar L, Shellsol 70, Shellsol 71, Amsco OMS, and Amsco 460. These solvents may be used alone or as a mixture thereof.

Other organic solvent(s) can be used, if desired, together with the above described non-aqueous solvent for the production of the dispersion resin grains and examples thereof include alcohols (e.g., methyl alcohol, ethyl alcohol, propyl alcohol, butyl alcohol, and fluorinated alcohols), ketones (e.g., acetone, methyl ethyl ketone, and cyclohexane), carboxylic acid esters (e.g., methyl acetate, ethyl acetate, propyl acetate, butyl acetate, methyl propionate and ethyl propionate), ethers (e.g., diethyl ether, dipropyl ether, tetrahydrofuran, and dioxane), and halogenated hydrocarbons (e.g., methylene dichloride, chloroform, carbon tertachloride, dichloroethane, and methyl chloroform).

It is preferred that the non-aqueous solvent(s) which are used as a mixture with the above described non-aqueous solvent are distilled off by heating or under reduced pressure after the polymerization granulation is completed. However, even when such a solvent is brought into the liquid developer as a latex grain dispersion, the existence of the solvent gives no problem as long as the liquid electric resistance of the liquid developer containing the solvent satisfies the condition that the electric resistance of the solvent is at least $10^9\ \Omega$ cm.

In general, it is preferred that the same solvent as the liquid carrier for the liquid developer is used in the step of forming the resin grain dispersion and, such a solvent includes the straight chain or branched aliphatic hydrocarbon, alicyclic hydrocarbon, aromatic hydrocarbon, and halogenated hydrocarbon, as described above.

The dispersion-stabilizing resin for use in the present invention is a comb-like copolymer obtained by polymerizing a solution containing at least the mono-functional macromonomer (M) and the monomer represented by the general formula (III) described above and has a feature that the copolymer is soluble in the above described non-aqueous solvent. Particularly, it is characterized in that the comb-like copolymer contains at random the above described specific polar groups selected from $-COOH$, $-PO_3H_2$, $-SO_3H$,

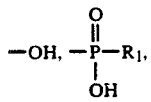

$-SH$, a formyl group and an amino group in the teeth portions of the comb.

It is preferred in the present invention that the above described comb-like copolymer has the specific polar group selected from $-PO_3H_2$, $-SO_3H$, $-COOH$, $-OH$, $-SH$,

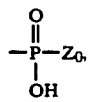

a formyl group and an amino group as described above bonded to one terminal of the polymer main chain of the comb-like copolymer.

The weight average molecular weight of the comb-like copolymer is suitably from $2\times10^4$ to $2\times10^5$, and preferably from $3\times10^4$ to $1\times10^5$. If the weight average molecular weight thereof is less than $2\times10^4$ or more than $2\times10^5$, the average grain size of the resin grains obtained by the polymerization granulation may become coarse or the distribution of the grain sizes become broad to reduce the dispersibility of the resin grains or to cause, sometimes, the aggregation of the resin grains.

The proportion of the mono-functional macromonomer (M) as a copolymerizable component of the comb-like copolymer is from 1% by weight to 70% by weight, and preferably from 5% by weight to 50% by weight based on the weight of the copolymer. If the proportion thereof is less than 1% by weight, the number of teeth portions of the comb is greatly reduced to form a chemical structure as a conventional random copolymer, whereby the improvement of the re-dispersibility contemplated in the present invention is not obtained. On the other hand, if the proportion exceeds 70% by weight, the copolymerizing property with the monomer represented by the general formula (III) becomes insufficient. Also, the content of the monomer represented by the general formula (III) existing in the above described comb-like copolymer as another copolymerizable component is from 30% by weight to 99% by weight, and preferably from 50% by weight to 95% by weight.

On the other hand, the weight average molecular weight of the macromonomer (M) which forms the teeth portion of the comb-like copolymer in the present invention is from $1\times10^3$ to $2\times10^4$, and preferably from $2\times10^3$ to $1\times10^4$. If the weight average molecular weight thereof is less than $1\times10^3$, the re-dispersibility of the dispersion resin grains obtained is lowered. On the other hand, if the weight average molecular weight exceeds $2\times10^4$, the copolymerizing property with the monomer represented by the general formula (III) is generally lowered, whereby a comb-like copolymer is not formed.

Since the comb-like copolymer in the present invention is required to be soluble in the above described non-aqueous solvent, the copolymer must contain solubilizing repeating unit(s) at the polymer chain portion and/or the teeth portion of the comb thereof. For this purpose, at least one of $Q_1$ and $Q_2$ in the component of macromonomer (M) represented by the general formula (IIa) and in the component of the monomer represented by the general formula (III), respectively, must be an aliphatic group having from 10 to 22 carbon atoms as described above.

More specifically, when the macromonomer (M) constituting the teeth portion of the comb-like copolymer contains the repeating unit represented by the general formula (IIa) and $Q_1$ in the general formula (IIa) is an aliphatic group having less than 10 carbon atoms or an aromatic group, or, when the macromonomer (M) contains the repeating unit represented by the general formula (IIb), $Q_2$ in the general formula (III) constituting the main chain portion of the polymer represents an aliphatic group having from 10 to 22 carbon atoms. Also, when $Q_2$ in the general formula (III) is an aliphatic group having less than 10 carbon atoms or an aromatic group, the macromonomer (M) being combined with the monomer represented by the general formula (III) contains at least the repeating unit represented by the general formula (IIa) wherein $Q_1$ is an aliphatic group having from 10 to 22 carbon atoms.

Now, the comb-like copolymer for use in the present invention will be described hereinafter in more detail.

The mono-functional macromonomer (M) is a macromonomer having a weight average molecular weight of from $1\times10^3$ to $2\times10^4$, comprising at least one copolymerizable component corresponding to a repeating unit represented by the general formula (IIa) or (IIb) described above and at least one copolymerizable component having at least one specific polar group (i.e., —COOH, $-PO_3H_2$, $-SO_3H$, $$-OH,\ -\overset{\overset{\displaystyle O}{\|}}{\underset{\underset{\displaystyle OH}{|}}{P}}-R_1,$$

—SH, a formyl group and/or an amino group), and having a polymerizable double bond group represented by the general formula (I) described above which is capable of being polymerized with the monomer represented by the general formula (III) bonded to only one terminal of the polymer main chain.

In the above described general formulae (I), (IIa), (IIb) and (III), the hydrocarbon groups represented by $X_0$, $a_1$, $a_2$, $X_1$, V, $b_1$, $b_2$, $X_2$, $d_1$, $d_2$, $Q_1$ and $Q_2$ each has the number of carbon atoms defined above (as unsubtituted hydrocarbon group) and the hydrocarbon groups may have one or more substituents.

In the general formula (I), when $X_0$ represents $$-\overset{\overset{\displaystyle R_{11}}{|}}{CON}- \text{ or } -\overset{\overset{\displaystyle R_{11}}{|}}{SO_2N}-,$$

$R_{11}$ represents a hydrogen atom or a hydrocarbon group, and preferred examples of the hydrocarbon group include an alkyl group having from 1 to 22 carbon atoms which may be substituted (e.g., methyl, ethyl, propyl, butyl, pentyl, hexyl, heptyl, octyl, decyl, dodecyl, tridecyl, tetradecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-porpenyl, 2-butenyl, 2-pentenyl, 3-methyl-2-pentenyl, 1-pentenyl, 1-hexenyl, 2-hexenyl, and 4-methyl -2-hexenyl), an aralkyl group having from 7 to 12 carbon atoms which may be substituted (e.g., benzyl, phenethyl, 3-phenylpropyl, naphthylmethyl, 2-naphthylethyl, chloronzyl, bromobenzyl, methylbenzyl, ethylbenzyl, methoxybenzyl, dimethylbenzyl and dimethoxybenzyl), and alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and dodecyloylamidophenyl).

When $X_0$ represents

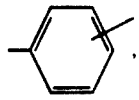

the benzene ring may have a substituent such as, for example, a halogen atom (e.g., chlorine and bromine), an alkyl group (e.g., methyl, ethyl, propyl, butyl, chloromethyl, methoxymethyl) and an alkoxy group (e.g., methoxy, ethoxy, propoxy, and butoxy).

In the general formula (I), $a_1$ and $a_2$, which may be the same or different, each represents a hydrogen atom, a halogen atom (e.g., chlorine and bromide), a cyano group, an alkyl group having from 1 to 4 carbon atoms (e.g., methyl, ethyl, propyl, and butyl), —COO—$Z_1$, or —COO$Z_1$ bonded via a hydrocarbon group (wherein $Z_1$ represents preferably a hydrogen atom, an alkyl group having from 1 to 18 carbon atoms, an alkenyl group having from 4 to 18 carbon atoms, an aralkyl group having from 7 to 12 carbon atoms, an alicyclic group having from 5 to 8 carbon atoms or an aryl group having from 6 to 12 carbon atoms, these groups may be substituted, and specific examples thereof are the same as those described above for $R_{11}$).

In the general formula (I), —COO—$Z_1$ may be bonded via a hydrocarbon group, and examples of the hydrocarbon group include a methylene, ethylene, and propylene group.

In the general formula (I), $X_0$ is more preferably —COO—, —OCO—, —$CH_2$OCO—, —$CH_2$COO—, —O—, —CONH, —$SO_2$NH—, or

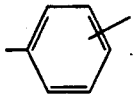

Also, $a_1$ and $a_2$, which may be the same or different, each represents preferably a hydrogen atom, a methyl group, —COO$Z_1$, or —$CH_2$COO$Z_1$ (wherein $Z_1$ represents more preferably a hydrogen atom or an alkyl group having from 1 to 6 carbon atoms (e.g., methyl, ethyl, propyl, butyl, and hexyl)). Most preferably, one of $a_1$ and $a_2$ represents a hydrogen atom.

That is, specific examples of the polymerizable double bond represented by the general formula (I)

include $CH_2{=}CH{-}\overset{O}{\overset{\|}{C}}{-}O{-}$, $CH_2{=}\overset{CH_3}{\overset{|}{C}}{-}\overset{O}{\overset{\|}{C}}{-}O{-}$, $CH_3{-}CH{=}CH{-}\overset{O}{\overset{\|}{C}}{-}O{-}$, $CH_2{=}\underset{O{=}C{-}O{-}}{\overset{CH_2COOCH_3}{\overset{|}{C}}}$, $CH_2{=}\underset{O{=}C{-}O{-}}{\overset{CH_2COOH}{\overset{|}{C}}}$, $CH_2{=}CH{-}CONH{-}$, $CH_2{=}\overset{CH_3}{\overset{|}{C}}{-}CONH{-}$, $CH_3{-}CH{=}CH{-}CONH{-}$, $CH_2{=}CH{-}O{-}\overset{O}{\overset{\|}{C}}{-}$, $CH_2{=}CH{-}CH_2{-}O{-}\overset{O}{\overset{\|}{C}}{-}$, $CH_2{=}CH{-}O{-}$, $CH_2{=}\overset{COOH}{\overset{|}{C}}{-}CH_2{-}\overset{O}{\overset{\|}{C}}{-}O{-}$, $CH_2{=}\overset{COOCH_3}{\overset{|}{C}}{-}CH_2{-}\overset{O}{\overset{\|}{C}}{-}O{-}$, and

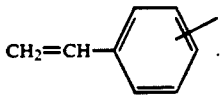

In the general formula (IIa) or (IIb), $X_1$ has the same meaning as $X_0$ in the general formula (I) and $b_1$ and $b_2$, which may be the same or different, have the same meanings as $a_1$ and $a_2$ in the general formula (I).

$Q_1$ represents an aliphatic group having from 1 to 22 carbon atoms or an aromatic group having from 6 to 12 carbon atoms.

Specific examples of the aliphatic group include those described for $R_{11}$ above. Also, preferred examples of $b_1$ and $b_2$ are same as those described above for $a_1$ and $a_2$ in the general formula (I).

In the general formula (IIb), V represents —CN, —$CONH_2$, or

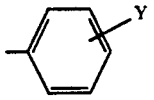

(wherein Y represents a hydrogen atom, a halogen atom (e.g., chlorine and bromine), an alkoxy group (e.g., methoxy, ethoxy, propoxy, and butoxy), or —COO$Z_2$ (wherein $Z_2$ preferably represents an alkyl group having from 1 to 8 carbon atoms, an aralkyl group having from 7 to 12 carbon atoms or an aryl group)).

The mono-functional macromonomer (M) in the present invention may have two or more polymerizable components (A) represented by the general formula (IIa) and/or the polymerizable components represented by the general formula (IIb).

As the polymerizable component (B) having the polar group (i.e., —COOH, —$PO_3H_2$, —$SO_3$H, —OH, $$-\overset{O}{\overset{\|}{\underset{OH}{\underset{|}{P}}}}-R_1,$$

—SH, a formyl group or an amino group), which is copolymerized with the copolymerizable component (A) represented by the general formula (IIa) or (IIb) in the macromonomer (M), any vinyl compounds having the above described polar group capable of copolymerized with the copolymerizable component (A) represented by the general formula (IIa) or (IIb) can be used.

Examples of these vinyl compounds are described, for example, in *Kobunshi Data Handbood* (*Kisohen*), edited by Kobunshi Gakkai, published by Baifukan K.K., 1986.

Specific examples thereof include acrylic acid,. an α- and/or β-substituted acrylic acid (e.g., α-acetoxy compound, α-acetoxymethyl compound, α-aminomethyl compound, α-chloro compound, α-bromo compound, α-fluoro compound, α-tributylsilyl compound, α-cyano compound, β-chloro compound, β-bromo compound, β-fluoro compound, β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl -2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, dicarboxylic acids, half ester derivatives of alcohols at the vinyl group or allyl group, and compounds having the acidic group in the substituent of ester derivatives or amido derivatives of these carboxylic acids or sulfonic acids.

In

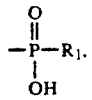

$R_1$ represents —$R_2$ or —$OR_2$ and $R_2$ represents a hydrocarbon group. Examples of the hydrocarbon groups include those described for $Q_1$ in the general formula (IIa) above.

The compounds containing —OH group include alcohols containing a vinyl group or an allyl group (e.g., allyl alcohol, methacrylates containing —OH group in an ester substituent thereof, and arylamides containing —OH group in an N-substituent thereof), hydroxyphenol, and methacrylates or amides containing a hydroxyphenyl group as a substituent.

Specific examples of the polymerizable component having the polar group described above are set forth below, but the present invention should not be construed as being limited thereto. In the following formulae, a represents —H, —$CH_3$, Cl, —Br, —CN, —$CH_2COOCH_3$, or —$CH_2COOH$; b represents —H or —$CH_3$; j represents an integer of from 2 to 18; k represents an integer of from 2 to 5; l represents an integer of from 1 to 4; m represents an integer of from 1 to 12; and n represents an integer of from 2 to 12.

(A-1)

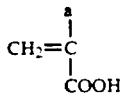

(A-2)

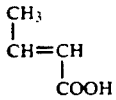

(A-3)

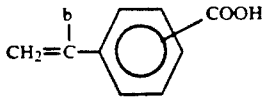

(A-4)

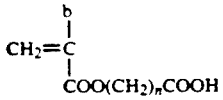

(A-5)

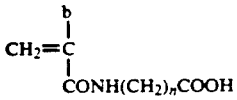

(A-6)

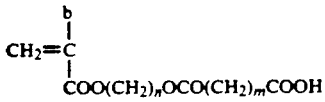

(A-7)

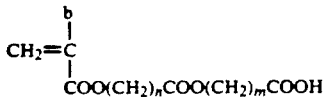

(A-8)

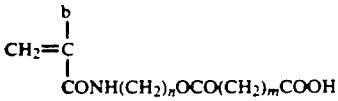

-continued (A-9)

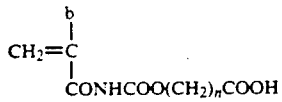

(A-10)

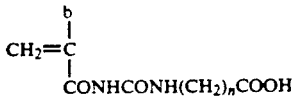

(A-11)

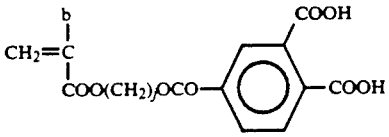

(A-12)

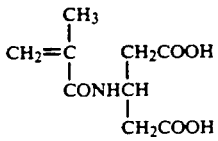

(A-13)

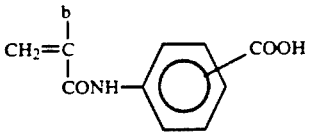

(A-14)

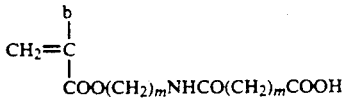

$CH_2=CH-CH_2OCO(CH_2)_mCOOH$ (A-15)

$CH_2=CH+CH_2\rangle_7COOH$ (A-16)

(A-17)

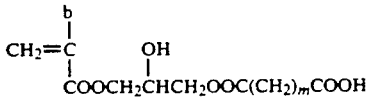

(A-18)

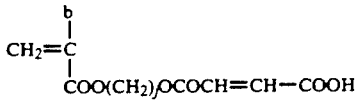

(A-19)

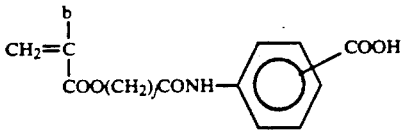

(A-20)

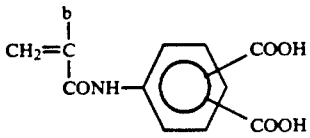

(A-21)

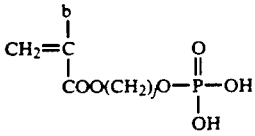

-continued
(A-22)
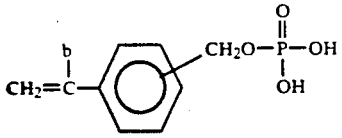
(A-23)
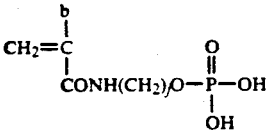
(A-24)
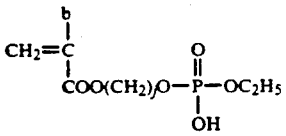
(A-25)
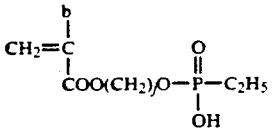
(A-26)
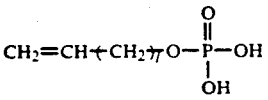
(A-27)
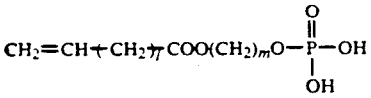
(A-28)
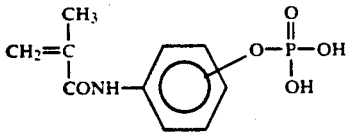
(A-29)
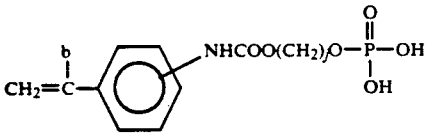
(A-30)
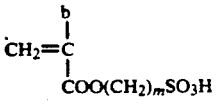
(A-31)
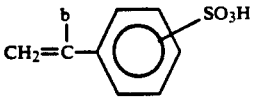
(A-32)
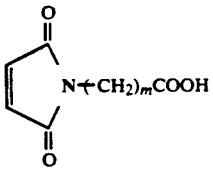
-continued
(A-33)
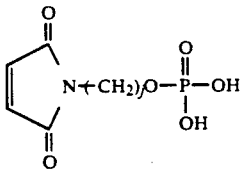
(A-34)
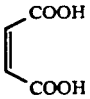
(A-35)
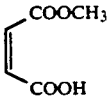
(A-36)
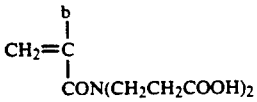
(A-37)
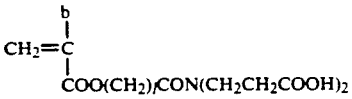
(A-38)
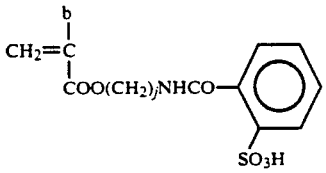
(A-39)
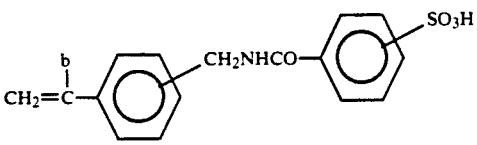
(A-40)
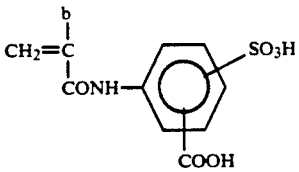
(A-41)
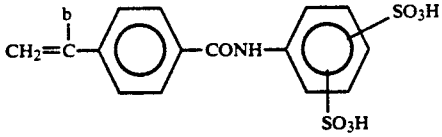
(A-42)
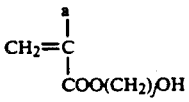
(A-43)
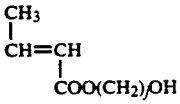
(A-44)
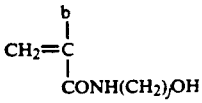

-continued (A-45)

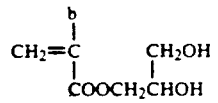

(A-46)

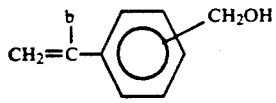

(A-47)

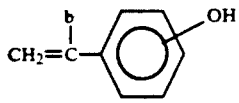

(A-48)

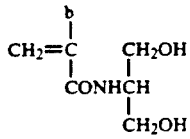

(A-49)

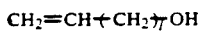

(A-50)

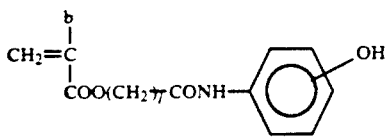

(A-51)

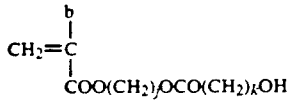

(A-52)

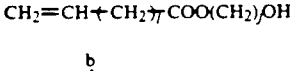

(A-53)

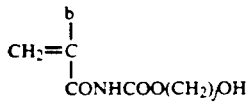

(A-54)

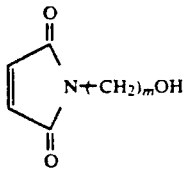

(A-55)

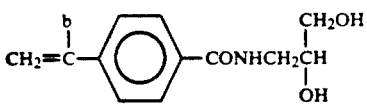

(A-56)

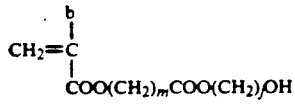

The content of the above described copolymerizable component having the polar group contained in the mono-functional macromonomer (M) is preferably from 0.5 to 50 parts by weight, and more preferably from 1 to 40 parts by weight per 100 parts by weight of the total copolymerizable components.

When the mono-functional macromonomer (M) composed of a random copolymer having the polar group exists in the comb-like copolymer as a copolymerizable component, the total content of the polar group-containing component contained in the total graft portions in the comb-like copolymer is preferably from 0.1 to 10 parts by weight per 100 parts by weight of the total copolymerizable components in the comb-like copolymer. When the comb-like copolymer has the polar group selected from —COOH, $—SO_3H$, and $—PO_3H_2$, the total content of the polar group in the graft portions of the comb-like copolymer is more preferably from 0.1 to 5 parts by weight.

The macromonomer (M) may further contain other copolymerizable component(s) in addition to the above described copolymerizable components (A) and (B).

As such a monomer corresponding to other polymerizable recurring unit, there are acrylonitrile, methacrylonitrile, acrylamides, methacrylamides, styrene, styrene derivatives (e.g., vinyltoluene, chlorostyrene, dichlorostyrene, bromostyrene, hydroxymethylstyrene, and N,N-dimethylaminomethylstyrene), and heterocyclic vinyl compounds (e.g., vinylpyridine, vinylimidazole, vinylpyrrolidone, vinylthiophene, vinylpyrazole, vinyldioxane and vinyloxazine).

When the macromonomer (M) contains such a monomer described above, the content of the monomer is preferably from 1 to 20 parts by weight per 100 parts by weight of the total copolymerizable components in the macromonomer (M).

The macromonomer (M) for use in the present invention has a chemical structure that the polymerizable double bond group represented by the general formula (I) is bonded directly or through an appropriate linkage group to only one terminal of the main chain of the random polymer composed of at least the repeating unit represented by the general formula (IIa) and/or the repeating unit represented by the general formula (IIb) and the repeating unit having the specific polar group.

The linkage group bonding the component represented by the general formula (I) to the component represented by the general formula (IIa) or (IIb) or the polar group-containing component includes a carbon-carbon bond (single bond or double bond), carbon-hetero atom bond (examples of the hetero atom include oxygen, sulfur, nitrogen, and silicon), and a hetero atom-hetero atom bond, or an appropriate combination of these atomic groups.

Specific examples of the linkage group include a single linkage group selected from

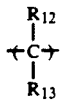

(wherein $R_{12}$ and $R_{13}$ each represents a hydrogen atom, a halogen atom (e.g., fluorine, chlorine, and bromine), a cyano group, a hydroxy group, or an alkyl group (e.g., methyl, ethyl, and propyl),

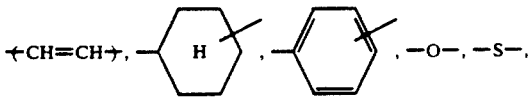

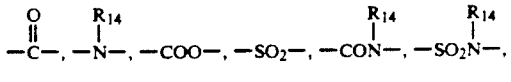

-continued

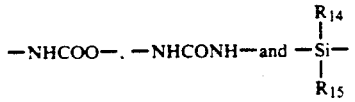

(wherein $R_{14}$ and $R_{15}$ each represents a hydrogen atom or a hydrocarbon group as described for $Q_1$ in the general formula (IIa) above) and a linkage group composed of two or more of these linkage groups.

The macromonomer (M) for use in the present invention can be produced by known synthesis methods.

Specifically, the macromonomer can be synthesized by a radical polymerization method of forming the macromonomer by reacting an oligomer having a reactive group bonded to the terminal and various reagents. The oligomer used above can be obtained by a radical polymerization using a polymerization initiator and/or a chain transfer agent each having a reactive group such as a carboxy group, a carboxy halide group, a hydroxy group, an amino group, a halogen atom, or an epoxy group in the molecule thereof.

Specific methods for producing the macromonomer (M) are described, for example, in P. Dreyfuss & R.P. Quirk, *Encycl. Polym. Sci. Eng.*, 7, 551 (1987), P.F. Rempp & E. Franta, *Adv. Polym. Sci.*, 58, 1 (1984), Yusuke Kawakami, *Kagaku Kogyo* (*Chemical Industry*), 38, 56 (1987), Yuya Yamashita, *Kobunshi* (*Macromolecule*), 31, 988 (1982), Shiro Kobayashi, *Kobunshi* (*Macromolecule*), 30, 625 (1981), Koichi Ito, *Kobunshi Kako* (*Macromolecular Processing*), 35, 262 (1986), Kishiro Higashi & Takashi Tsuda, *Kino Zairyo* (*Functional Materials*), 1987, No. 10, 5, and the literature references and patents cited in these references.

However, since the macromonomer (M) used in the present invention has the above described polar group as the component of the repeating unit, the following matters should be considered in the synthesis thereof.

In one method, the radical polymerization and the introduction of a terminal reactive group are carried out by the above described method using a monomer having the polar group as the form of a protected functional group as described, for example, in the following Reaction Scheme (I).

Reaction Scheme (I)

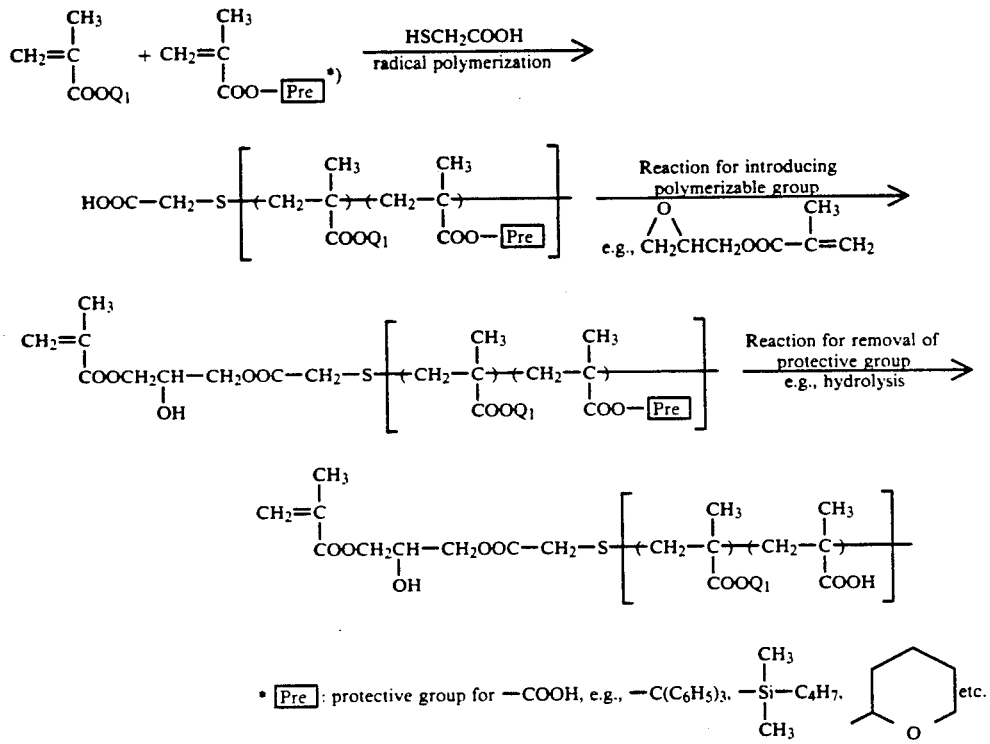

The reaction for introducing the protective group and the reaction for removal of the protective group (e.g., hydrolysis reaction, hydrogenolysis reaction, and oxidation-decomposition reaction) for the polar group (i.e., $—SO_3H$, $—PO_3H_2$,

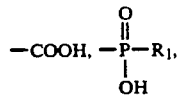

—OH, —SH, a formyl group, or an amino group) which is at random contained in the macromonomer (M) for use in the present invention can be carried out by any of conventional methods.

The methods which can be used are specifically described, for example, in J.F.W. McOmie, *Protective Groups in Organic Chemistry*, Plenum Press (1973), T.W. Greene, *Protective Groups in Organic Synthesis*, John Wiley & Sons (1981), Ryoohei Oda, *Macromolecular Fine Chemical*, Kodansha K.K., (1976), Yoshio Iwakura and Keisuke Kurita, *Hannosei Kobunshi* (*Reactive Macromolecules*), Kodansha K.K. (1977), G. Berner, et al, *J. Radiation Curing*, No. 10, p. 10(1986), JP-A-62-212669, JP-A-62-286064, JP-A-62-210475, JP-A-62-195684, JP-A-62-258476, JP-A-63-260439, JP-A-01-63977 and JP-A-01-70767.

Another method for producing the macromonomer (M) comprises synthesizing the oligomer in the same manner as described above and then reacting the oligomer with a reagent having a polymerizable double bond group which reacts with only "specific reactive group" bonded to one terminal by utilizing the difference between the reactivity of the "specific reactive group" and the reactivity of the polar group contained in the oligomer as shown in the following reaction scheme (II).

Reaction Scheme (II)

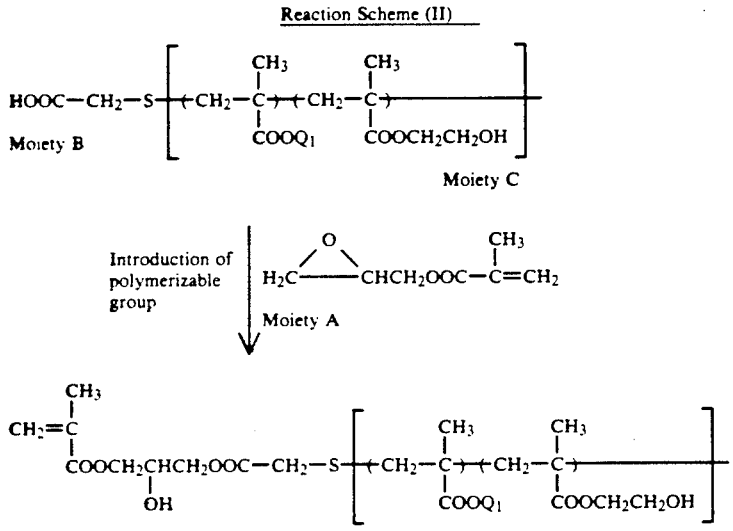

Specific examples of a combination of the specific functional groups (moieties A, B, and C) described in the reaction scheme (II) are set forth in Table A below but the present invention should not be construed as being limited thereto. It is important to utilize the selectivity of reaction in an ordinary organic chemical reaction and the macromonomer may be formed without protecting the polar group in the oligomer. In Table A, Moiety A is a functional group in the reagent for introducing a polymerizable group, Moiety B is a specific functional group at the terminal of oligomer, and Moiety C is a polar group in the repeating unit in the oligomer.

TABLE A

| Moiety A | Moiety B | Moiety C |
|---|---|---|
| 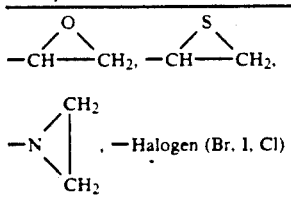 —Halogen (Br, I, Cl) | —COOH, —$NH_2$ | —OH |
| —COCl, Acid Anhydride<br>—$SO_2Cl$, | —OH, —$NH_2$ | —COOH, —$SO_3H$, —$PO_3H_2$, 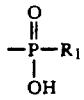 |
| —COOH, —$NHR_{16}$<br>(wherein $R_{16}$ is a hydrogen atom or an alkyl group) | —Halogen | —COOH, —$SO_3H$, —$PO_3H_2$, —OH, 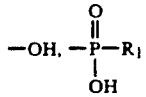 |
| —COOH, —$NHR_{16}$ | 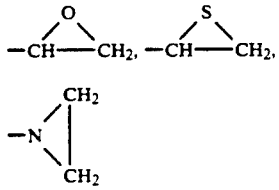 | —OH |
| —OH, —$NHR_{16}$ | —COCl, —$SO_2Cl$ | —COOH, —$SO_3H$, —$PO_3H_2$ |

The chain transfer agent which can be used for producing the oligomer includes, for example, mercapto compounds having a specific reactive substituent capable of being derived into the polar group later (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl) carbamoylpropionic acid, 3-[N-(2-mercaptoethyl-)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, and 2-mercapto-3-pyridinol), disulfide compounds which are the oxidation products of these mercapto compounds, and iodinated alkyl compounds having the above described polar group or specific reactive substituent (e.g., iodoacetic acid, iodopropionic acid, 2-iodoethanol, 2-iodoethanesulfonic acid, and 3-iodopropanesulfonic acid). In these compounds, the mercapto compounds are preferred.

Also, as the polymerization initiator having a specific reactive group, which can be used for the production of the oligomer, there are, for example, 2,2'-azobis(2-cyanopropanol), 2,2'-azobis(2-cyanopentanol), 4,4'-azobis(4-cyanovaleric acid), 4,4'-azobis(4-cyanovaleric acid chloride), 2,2'-azobis[2-(5-methyl-2-imidazolin-2-yl)propane], 2,2'-azobis[2-(2-imidazolin-2-yl)propane], 2,2'-azobis[2-(3,4,5,6-tetra-hydropyrimidin -2-yl)propane], 2,2'-azobis{2-[1-(2-hydroxyethyl)-2-imidazolin-2-yl]propane}, 2,2'-azobis[2-methyl-N-(2-hydroxyethyl) propionamide] and the derivatives thereof.

The chain transfer agent or the polymerization initiator is used in an amount of from 0.1 to 15 parts by weight, and preferably from 0.5 to 10 parts by weight per 100 parts by weight of the total monomers.

Specific examples of the mono-functional macromonomer (M) for use in the present invention are set forth below, but the present invention should not be construed as being limited thereto.

In the following formulae, b represents —H or —$CH_3$, d represents —H, —$CH_3$, or —$CH_2COOCH_3$, R represents —$C_nH_{2n+1}$ (wherein n represents an integer of from 1 to 22), —$CH_2C_6H_5$,

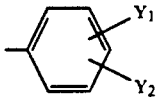

(wherein $Y_1$ and $Y_2$ each represents —H, —Cl, —Br, —$CH_3$, —$COCH_3$, or —$COOCH_3$)

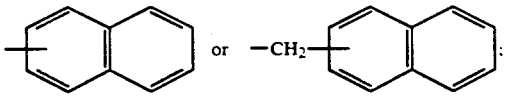

$W_1$ represents —CN, —$OCOCH_3$, —$CONH_2$, or —$C_6H_5$; $W_2$ represents —Cl, —BR, —CN, or —$OCH_3$; r represents an integer of from 2 to 18; s represents an integer of from 2 to 12; and t represents an integer of 2 to 4.

(M-1)

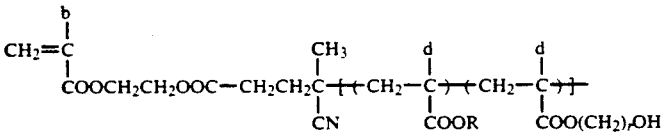

(M-2)

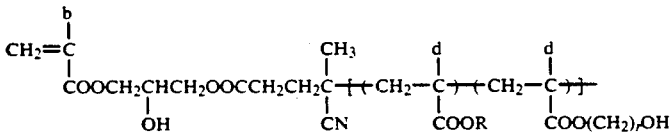

(M-3)

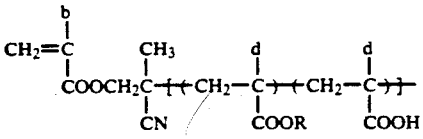

(M-4)

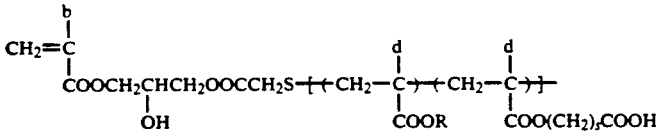

(M-5)

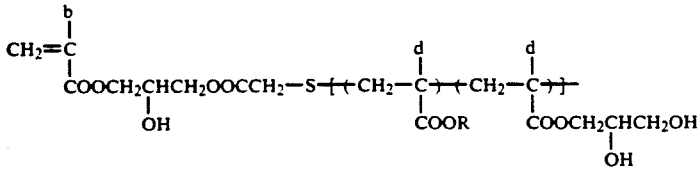

-continued
(M-6)
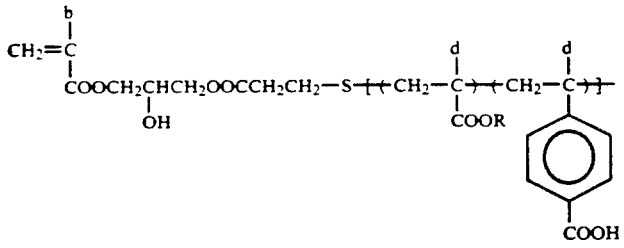
(M-7)
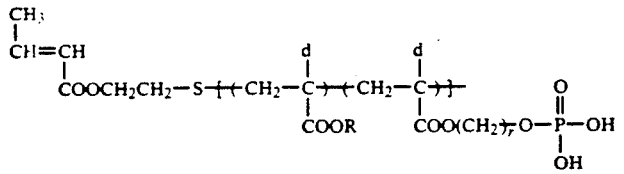
(M-8)
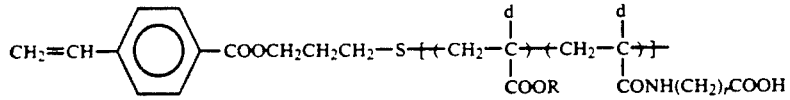
(M-9)
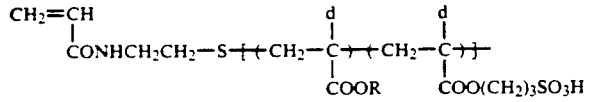
(M-10)
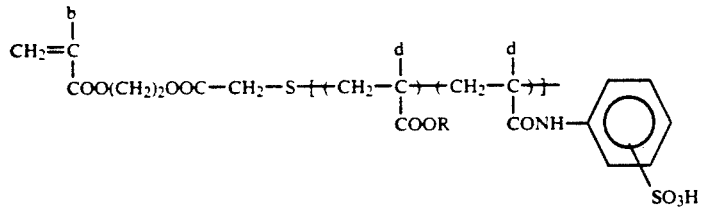
(M-11)
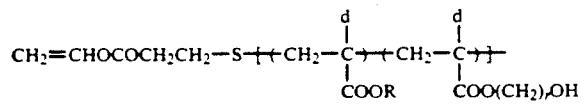
(M-12)
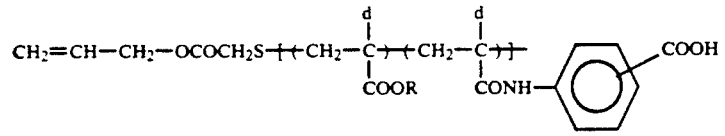
(M-13)
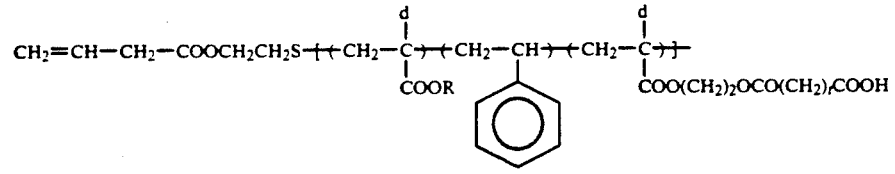
(M-14)
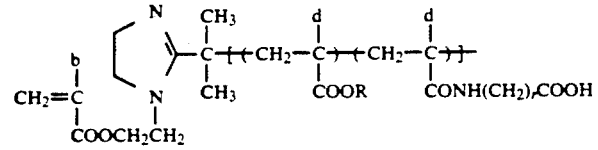

-continued
(M-15)
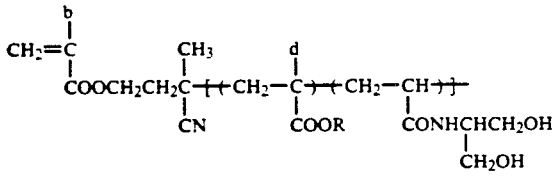
(M-16)
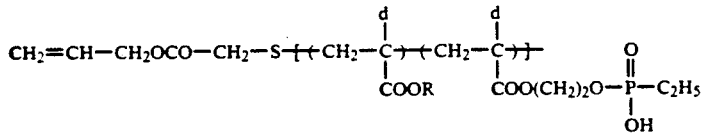
(M-17)
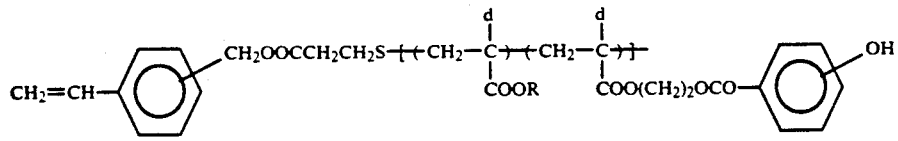
(M-18)
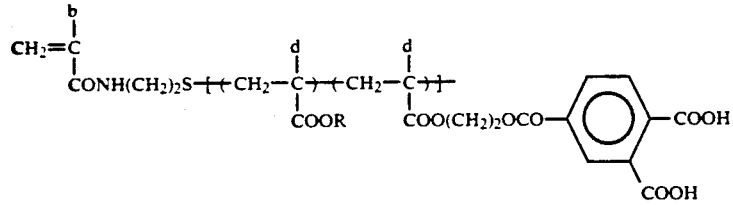
(M-19)
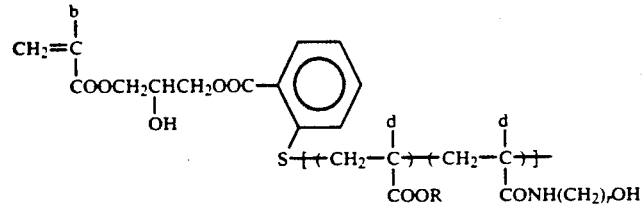
(M-20)
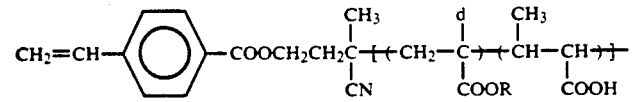
(M-21)
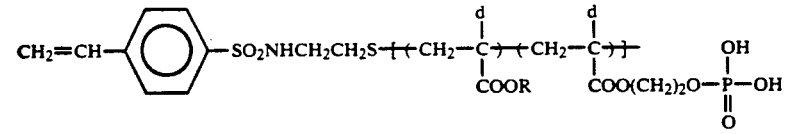
(M-22)
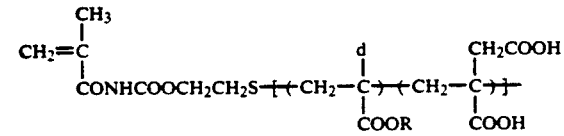
(M-23)
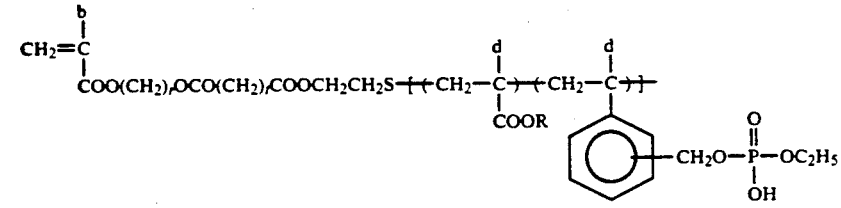

-continued (M-24)

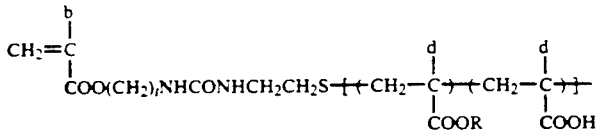

(M-25)

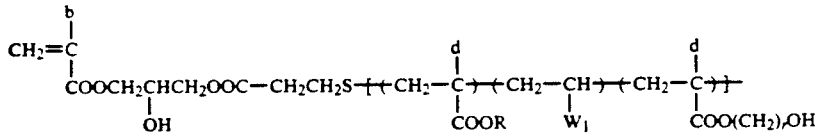

(M-26)

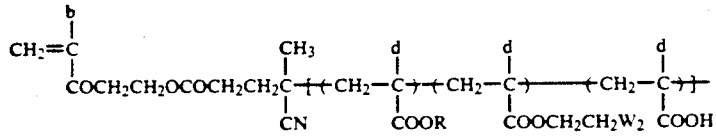

On the other hand, the monomer which is copolymerized with the above described mono-functional macromonomer (M) is represented by the general formula (III) described above.

In the general formula (III), $d_1$ and $d_2$, which may be the same or different, have the same meaning as $a_1$ and $a_2$ in the general formula (I) and $X_2$ and $Q_2$ have the same meaning as $X_0$ and $Q_2$ have the same meaning as $X_0$ and $Q_1$ in the general formula (IIa) and (IIb), respectively.

Also, the comb-like copolymer containing no copolymerizable component having the polar group such as $-PO_3H_2$, $-SO_3H$, $-COOH$, $-OH$,

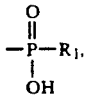

—SH, a formyl group or an amino group in the polymer main chain is preferred.

Furthermore, the comb-like copolymer for use in the present invention may contain other monomers as additional copolymerizable components together with the mono-functional macromonomer (M) and the monomer represented by the general formula (III).

Examples of such an additional monomer include α-olefins, alkanoic acid vinyl or allyl esters, acrylonitrile, methacrylonitrile, vinyl ethers, acrylamides, methacrylamides, styrenes, and heterocyclic vinyl compounds (e.g., vinylpyfrolidone, vinylpyridine, vinylimidazole, vinylthiophene, vinylimidazoline, vinylpyrazole, vinyldioxane, vinylquinoline, vinylthiazole, and vinyloxazine).

In this case, the content of such an additional monomer other than the macromonomer (M) and the monomer represented by the general formula (III) should not exceed 30% by weight of the total monomer components of the comb-like copolymer.

Furthermore, the comb-like copolymer for use in the present invention may preferably have the specific polar group at only one terminal of the polymer main chain thereof.

Specifically, the polar group is selected from $-PO_3H_2$, $-SO_3H$, $-COOH$, $-OH$, —SH,

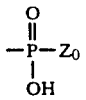

(wherein $Z_0$ represents $-Z_{10}$ or $-OZ_{10}$ (wherein $Z_{10}$ represents a hydrocarbon group)), a formyl group, and an amino group.

In the polar group represented by

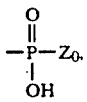

$Z_{10}$ for $Z_0$ represents preferably a hydrocarbon group having from 1 to 18 carbon atoms, and preferred examples of the hydrocarbon group include an aliphatic group having from to 8 carbon atoms, which may be substituted (e.g., methyl, ethyl, propyl, butyl, pentyl, hexyl, butenyl, pentenyl, hexenyl, 2-chloroethyl, 2-cyanoethyl, cyclopentyl, cyclohexyl, benzyl, phenethyl, chlorobenzyl, and bromobenzyl) and an aromatic group which may be substituted (e.g., phenyl, tolyl, xylyl, mesityl, chlorophenyl, bromophenyl, methoxyphenyl, and cyanophenyl).

Also, in the above described polar groups, the amino group represents $-NH_2$, $-NHZ_{11}$, or

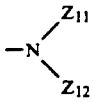

wherein $Z_{11}$ and $Z_{12}$ each represents a hydrocarbon group having from 1 to 18 carbon atoms, and preferably 1 to 8 carbon atoms. Specific examples of the hydrocarbon group for $Z_{11}$ and $Z_{12}$ include those described above for $Z_{10}$.

Furthermore, more preferred hydrocarbon groups represented by $Z_{10}$, $Z_{11}$, or $Z_{12}$ include an alkyl group having from 1 to 4 carbon atoms, which may be substituted, a benzyl group which may be substituted and a phenyl group which may be substituted.

In this case, the comb-like copolymer has a chemical structure that the polar group is bonded to one terminal of the polymer main chain directly or via an appropriate linkage group. The linkage group bonding the polar group to the comb-like copolymer component is composed of an appropriate combination of atomic groups such as a carbon-carbon bond (single bond or double bond), a carbon-hetero atom bond (examples of the hetero atom include oxygen, sulfur, nitrogen and silicon), and a hetero atom-hetero atom bond.

Specific examples thereof are linkage groups composed of a single atomic group selected from

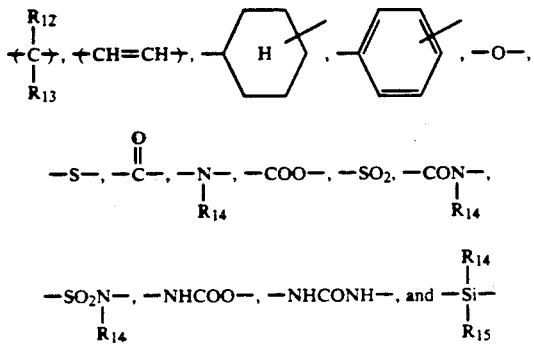

(wherein $R_{12}$, $R_{13}$, and $R_{14}$ are the same as defined above) and a linkage group composed of a combination of two or more atomic groups described above.

The comb-like copolymer having the polar group at the terminal of the polymer main chain thereof can be synthesized by using a polymerization initiator or chain transfer agent having the polar group or a specific reactive group which can be induced into the polar group in its molecule in the polymerization reaction of at least the mono-functional macromonomer (M) and the monomer represented by the general formula (III).

Specifically, the comb-like copolymer of the type can be synthesized in the same manner as the case of producing the oligomer having a reactive group bonded at one terminal as described above in the synthesis of the macromonomer (M).

As described above, the dispersion-stabilizing resin for use in the present invention is a comb-like copolymer obtained by polymerizing a solution containing at least the mono-functional macromonomer (M) and the monomer represented by the general formula (III) described above and it is characterized in that the comb-like copolymer contains at random the above described specific polar groups selected from —COOH, $—PO_3H_2$, $—SO_3H$, —OH

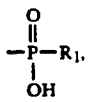

—SH, a formyl group and an amino group in the teeth portions of the comb.

On the contrary, conventional random copolymers containing copolymerizable components having a polar group have the polar groups bonded directly or through a linkage group to the polymer main chain.

When such a polar group-containing polymer is employed as the dispersion-stabilizing resin, it is believed that the polar group-containing polymer is physicochemically adsorbed on the dispersed resin grain mainly at its polar group portion. The comb-like copolymer according to the present invention is easily adsorbed on the resin grain in three dimensions as compared with conventional random copolymer.

Further, the comb-like copolymer according to the present invention has a repeating unit soluble in a non-aqueous solvent in either its polymer main chain or its teeth portion or both thereof. The steric effect due to such a repeating unit portion seems to effectively function to achieve the effect of the present invention.

As the monomer (A) used in the production of non-aqueous dispersion resin grains according to the present invention, any mono-functional monomers which are soluble in the above described non-aqueous solvent but become insoluble in the non-aqueous solvent by being polymerized can be employed. Specific examples of the monomers are represented by the following general formula (V):

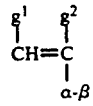

(V)

wherein $\alpha$ represents —COO—, OCO—, $—CH_2OCO—$, $—CH_2COO—$, —O—,

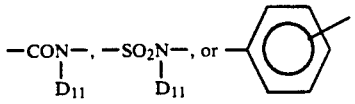

(wherein $D_{11}$ represents a hydrogen atom or an aliphatic group having from 1 to 18 carbon atoms which may be substituted (e.g., methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, fluorobenzyl, 2-methoxyethyl, and 3-methoxypropyl)); $\beta$ represents a hydrogen atom or an aliphatic group having from 1 to 6 carbon atoms which may be substituted (e.g., methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxypropyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl, and dichlorohexyl): and $g_1$ and $g_2$, which may be the same or different, each represents a hydrogen atom, a halogen atom, a cyano group, a hydrocarbon group having from 1 to 8 carbon atoms, $—COO—E_6$, or $—COO—E_6$ bonded via a hydrocarbon group having from 1 to 8 carbon atoms (wherein $E_6$ represents a hydrogen atom or a hydrocarbon group having from 1 to 18 carbon atoms. Preferably $g_1$ and $g_2$ each represents a hydrogen atom, a halogen atom (e.g., chlorine, bromine, and fluorine), a cyano group, an alkyl group having from 1 to 3 carbon atoms (e.g., methyl, ethyl, and propyl), $—COO—E_6$ or $—CH_2COOE_6$ (wherein $E_6$ represents preferably a hydrogen atom, an alkyl group having from 1 to 18 carbon atoms, an alkenyl group, an aralkyl group, an alicyclic group, or an aryl group, each group may be substituted, and specific examples of $E_6$ are the same as those described above for $R_{11}$).

$E_6$ more preferably represents an alkyl group having from 1 to 8 carbon atoms (e.g., methyl, ethyl, propyl, butyl, pentyl, hexyl, and octyl), an aralkyl group having from 7 to 9 carbon atoms (e.g., benzyl, phenethyl, and 3-phenylpropyl) or a phenyl group which may be substituted (e.g., phenyl, tolyl, xylyl, and methoxyphenyl).

More preferably, one of $g_1$ and $g_2$ is a hydrogen atom.

Specific examples of the mono-functional monomer (A) are vinyl esters or allyl esters of an aliphatic carboxylic acid having from 1 to 6 carbon atoms (e.g., acetic acid, propionic acid, butyric acid, monochloroacetic acid, and trifluoropropionic acid); alkyl esters or alkylamides having from 1 to 4 carbon atoms, which may be substituted, of an unsaturated carboxylic acid such as acrylic acid, methacrylic acid, crotonic acid, itaconic acid, or maleic acid (examples of the aforesaid alkyl moeity include methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4-carboxybutyl, 3-sulfopropyl, 4-sulfobutyl, 3-chloropropyl. 2-hydroxy-3-chloropropyl, 2-furfurylethyl, 2-pyridinylethyl, 2-thienylethyl, trimethoxysilylpropyl, and 2-carboxyamidoethyl); styrene derivatives (e.g., styrene, vinyltoluene, α-methylstyrene, vinylnaphthalene, chlorostyrene, dichlorostyrene, bromostyrene, vinylbenzenecarboxylic acid, vinylbenzenesulfonic acid, chloromethylstyrene, hydroxymethylstyrene, methoxymethylstyrene, N,N-dimethylaminomethylstyrene, vinylbenzenecarboxyamide, and vinylbenzenesulfonamide); unsaturated carboxylic acids such as acrylic acid, methacrylic acid, crotonic acid, maleic acid, or itaconic acid; cyclic anhydrides of maleic acid or itaconic acid; acrylonitrile; methacrylonitrile; and heterocyclic compounds having a polymerizable double bond group (specific examples include the compounds described in *Kobunshi (Macromolecule) Data Handbook*, pages 175 to 184, edited by Kobunshi Gakkai, published by Baifukan (1986), such as N-vinylpyridine, N-vinylimidazole, N-vinylpyrrolidone, vinylthiophene, vinyltetrahydrofuran, vinyloxazoline, vinylthiazole, and N-vinylmorpholine).

The above described mono-functional monomers (A) may be used alone or as a mixture thereof.

According to a preferred embodiment of the present invention, the dispersion resin grains for use in the present invention are obtained by copolymerizing a monomer (B-1) containing an aliphatic group having at least 8 carbon atoms with the above described mono-functional monomer (A) which is soluble in the non-aqueous solvent but becomes insoluble therein by polymerization.

Specific examples of the monomer (B-1) having an aliphatic group of at least 8 carbon atoms are represented by the following general formula (IV-1):

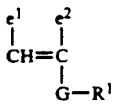

(IV-1)

wherein $R^1$ represents an aliphatic group having at least 8 carbon atoms; G represents —COO—, —CONH—,

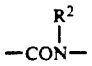

(wherein $R^2$ represents an aliphatic group), —OCO—, —$CH_2$COO— or —O—, and $e^1$ and $e^2$, which may be the same or different, each represents a hydrogen atom, an alkyl group, —$COOR^3$, or —$CH_2$—$COOR^3$ (wherein $R^3$ represents an aliphatic group).

Now, the monomer (B-1) represented by the general formula (IV-1) is described in detail below.

In a preferred embodiment of the monomer represented by the general formula (IV-1), $R^1$ represents an alkyl group having at least 10 total carbon atoms, which may be substituted, or an alkenyl group having at least 10 total carbon atoms, which may be substituted; G represents —COO—, —CONH—,

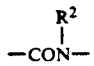

wherein $R^2$ represents preferably an aliphatic group having from 1 to 32 carbon atoms (e.g., an alkyl group, an alkenyl group or an aralkyl group)), —OCO—, —$CH_2$OCO—, or —O—; and $e^1$ and $e^2$, which may be the same or different, each represents preferably a hydrogen atom, a methyl group, —$COOR^3$, or —$CH_2COOR^3$ (wherein $R^3$ represents preferably an alkyl group having from 1 to 32 carbon atoms, an alkenyl group having from 4 to 32 carbon atoms, an aralkyl group having from 7 to 32 carbon atoms or a cycloalkyl group having from 5 to 32 carbon atoms).

In formula (IV-1), it is more preferably that G represents —COO—, —CONH—, or

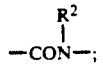

$e^1$ and $e^2$, which may be the same or different, each represents a hydrogen atom or a methyl group; and $R^1$ is the same as above.

Specific examples of the monomer (B-1) represented by the general formula (IV-1) described above are esters of an unsaturated carboxylic acid such as acrylic acid, methacrylic acid, crotonic acid, maleic acid, or itaconic acid, having an aliphatic group having from 10 to 32 total carbon atoms (the aliphatic group may have a substituent such as a halogen atom, a hydroxy group, an amino group, or an alkoxy group, and the carbon-carbon bond of the main chain thereof may contain a hetero atom such as oxygen, sulfur, or nitrogen, and examples of the aliphatic group include decyl, dodecyl, tridecyl, tetradecyl, hexadecyl, octadecyl, docosanyl, dodecenyl, hexedecenyl, oleyl, linoleyl, and docosenyl); amides of the above described unsaturated carboxylic acid having aliphatic group (examples of the aliphatic group are the same as those described above for the esters); vinyl esters or allyl esters of higher fatty acid (examples of the higher fatty acid include lauric acid, myristic acid, stearic acid, oleic acid, linolic acid, and behenic acid); and vinyl ethers substituted with an aliphatic group having from 10 to 32 total carbon atoms (examples of the aliphatic group are the same as those of the aliphatic group of the above described unsaturated carboxylic acid).

According to the above described embodiment, the dispersion resin grains are composed of at least one kind of the mono-functional monomer (A) and at least one kind of the monomer (B-1). It is important that the resin grains synthesized by these monomers are insoluble in the above described non-aqueous solvent in order to produce the desired dispersion resin grains.

More specifically, it is preferred that the proportion of the monomer (B-1) represented by the general formula (IV-1) in the dispersion resin grains is from 0.1 to 20% by weight based on the amount of the monomer (A) being insolubilized and also the proportion thereof is more preferably from 0.3 to 8% by weight.

The liquid developer for electrostatic photography according to the above described embodiment has the feature of very excellent re-dispersibility owing to the use of the monomer (B-1) in addition to the mono-functional monomer (A).

In accordance with another preferred embodiment of the present invention, the dispersion resin grains are obtained by copolymerizing the mono-functional monomer (A) which is soluble in the above described non-aqueous solvent but becomes insoluble in the non-aqueous solvent by being polymerized and a monomer (B-2) having at least two polar groups and/or polar linkage groups.

Practical examples of the monomer (B-2) having at least two polar groups and/or polar linkage groups are represented by the following general formula (IV-2):

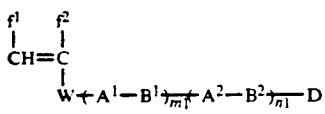

(IV-2)

wherein W represents —O—, —COO—, —OCO—, —$CH_2OCO$—, —$SO_2$—, —CONH, —$SO_2NH$—,

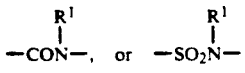

(wherein $R^1$ represents a hydrocarbon group or has the same meaning as the linkage group

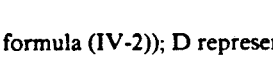

in the general formula (IV-2)); D represents a hydrogen atom or a hydrocarbon group having from 1 to 18 carbon atoms, which may be substituted with a halogen atom, —OH, —CN, —$NH_2$, —COOH, —$SO_3H$ or —$PO_3H_2$; $B^1$ and $B^2$, which may be the same or different, each represents —O—, —S—, —CO—, —$CO_2$—, —OCO—, —$SO_2$—,

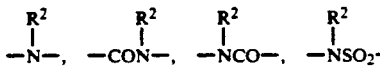

—$NHCO_2$—, or —NHCONH— (wherein $R^2$ has the same meaning as D described above); $A^1$ and $A^2$, which may be the same or different, each represents a hydrocarbon group having from 1 to 18 carbon atoms, which may be substituted or may have, in the main chain, a bond

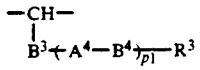

(wherein $B^3$ and $B^4$, which may be the same or different, have the same meaning as $B^1$ and $B^2$ described above; $A^4$ represents a hydrocarbon group having from 1 to 18 carbon atoms, which may be substituted; and $R^3$ has the same meaning as D described above); $f^1$ and $f^2$, which may be the same or different, each represents a hydrogen atom, a hydrocarbon group, —COO—$R^4$, or —COO—$R^4$ bonded via a hydrocarbon group (wherein $R^4$ represents a hydrogen atom or a hydrocarbon group which may be substituted); and $m_1$, $n_1$, and $p_1$, which may be the same or different, each represents an integer of from 0 to 4, with the proviso that $m_1$, $n_1$, and $p_1$ cannot be 0 at the same time.

Now, the monomer (B-2) represented by the general formula (IV-2) used in the present invention is described in detail below.

In formula (IV-2), W represents preferably —O—, —COO—, —OCO—, —$CH_2OCO$—, —CONH—, or

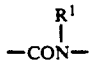

(wherein $R^1$ represents preferably an alkyl group having from 1 to 16 total carbon atoms which may be substituted, an alkenyl group having from 2 to 16 total carbon atoms which may be substituted, an alicyclic group having from 5 to 18 total carbon atoms which may be substituted, or has the same meaning as the linkage group,

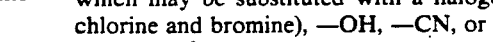

in the general formula (IV-2)).

D represents preferably a hydrogen atom or an aliphatic group having from 1 to 16 total carbon atoms (wherein examples of the aliphatic group include an alkyl group, an alkenyl group and an aralkyl group) which may be substituted with a halogen atom (e.g., chlorine and bromine), —OH, —CN, or —COOH.

$B^1$ and $B^2$, which may be the same or different, each represents preferably —O—, —S—, —CO—, —COO—, —OCO—,

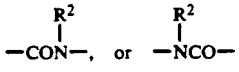

(wherein $R^2$ has the same meaning as D described above).

$A^1$ and $A^2$, which may be the same or different, each represents preferably a hydrocarbon group having from 1 to 12 carbon atoms (wherein examples of the hydrocarbon group include an alkylene group, an alkenylene group, an arylene group, and a cycloalkylene group) which may be substituted or may have

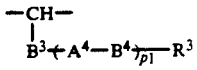

in the main chain bond (wherein $B^3$ and $B^4$, which may be the same or different, have the same meaning as $B^1$ and $B^2$ described above); $A^4$ represents preferably an alkylene group, an alkenylene group or an arylene group each having not more than 12 carbon atoms, each group may be substituted; and $R^3$ has the same meaning as R described above.

Also, $f^1$ and $f^2$, which may be the same or different, each represents preferably a hydrogen atom, a methyl group, —COO—$R^4$, or —$CH_2$COO—$R^4$ (wherein $R^4$ represents preferably a hydrogen atom, an alkyl group having from 1 to 18 carbon atoms, an alkenyl group having not more than 18 carbon atoms, an aralkyl group having not more than 18 carbon atoms, or a cycloalkyl group having not more than 18 carbon atoms).

Further, $m_1$, $n_1$, and $p_1$, which may be the same or different, each represents preferably an integer of from 0 to 3, with the proviso that $m_1$, $n_1$, and $p_1$ cannot be O at the same time.

Moreover, in a more preferred embodiment of the monomer (B-2) of the general formula (IV-2), W represents —COO—, —CONH— or $$-\overset{\overset{R^1}{|}}{C}ON-;$$

$f^1$ and $f^2$, which may be the same different, each represents a hydrogen atom, a methyl group, —COO—$R^4$, or —$CH_2$COO—$R^4$ (wherein $R^4$ represents more preferably an alkyl group having from 1 to 12 carbon atoms).

Furthermore, specific examples of $A^1$ and $A^2$ are composed of an appropriate combination of atomic groups of $$\left(\overset{\overset{R^6}{|}}{\underset{\underset{R^7}{|}}{C}}\right)$$

(wherein $R^6$ and $R^7$ each represents a hydrogen atom, an alkyl group, or a halogen atom), $$(CH{=}CH),\quad \text{ 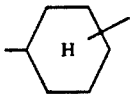 }\quad \text{and}\quad -\underset{\underset{B^3(A^4-B^4)_{p_1}-R^3}{|}}{CH}-$$

(wherein $B^3$, $B^4$, $A^3$, $A^4$, and $p_1$ each has the same meaning as described above).

Also, in the linkage group $$\overset{|}{W}(A^1-B^1)_{m_1}(A^2-B^2)_{n_1}-D$$

in the general formula (IV-2), each linkage main chain composed of W, $A^1$, $B^1$, $A^2$, $B^2$, and D is preferably composed of 8 or more total atoms. In this case, when W represents $$-\overset{\overset{R^1}{|}}{C}ON- \quad \text{or} \quad -\overset{\overset{R^1}{|}}{S}O_2N-$$

and $R^1$ represents $$(A^1-B^1)_{m_1}(A^2-B^2)_{n_1}-D.$$

the linkage main chain composed of $R^1$ is included in the above described linkage main chain. Furthermore, when $A^1$ and $A^2$ each is a hydrocarbon group having $$-\underset{\underset{B^3(A^4-B^4)_{p_1}-R^3}{|}}{CH}-$$

in the main chain bond, $$-B^3(A^4-B^4)_{p_1}-R^3$$

is included in the above described linkage main chain.

The number of atoms of the linkage main chain is as follows. For example, when W represents —COO— or —CONH—, the oxo group (=O) or the hydrogen atom therein is not included in the number of atoms in the linkage main chain, and the carbon atom, the ether-type oxygen atom and the nitrogen atom constituting the linkage main chain are included as the number of atoms thereof. Thus, the number of atoms of —COO— or —CONH— is counted as 2. Similarly, when D represents —$C_9H_{19}$, the hydrogen atoms are not included as the number of atoms in the linkage main chain, but the carbon atoms are included. Thus, in this case the number or atoms is counted as 9.

Specific examples of the monomer (B-2) are illustrated below.

$$CH_2{=}\overset{\overset{CH_3}{|}}{\underset{\underset{COO(CH_2)_2OCOC_9H_{19}}{|}}{C}} \qquad \text{(IV-2-1)}$$

$$CH_2{=}\overset{\overset{CH_3}{|}}{\underset{\underset{COO(CH_2)_2OCOC_{11}H_{23}}{|}}{C}} \qquad \text{(IV-2-2)}$$

$$CH_2{=}\overset{\overset{CH_3}{|}}{\underset{\underset{COO(CH_2)_2OCO(CH_2)_5OCOCH_3}{|}}{C}} \qquad \text{(IV-2-3)}$$

$$CH_2{=}\overset{\overset{CH_3}{|}}{\underset{\underset{COO(CH_2)_{10}OCOC_6H_{13}}{|}}{C}} \qquad \text{(IV-2-4)}$$

$$CH_2{=}\overset{\overset{CH_3}{|}}{\underset{\underset{COO(CH_2)_{10}COOC_8H_{17}}{|}}{C}} \qquad \text{(IV-2-5)}$$

$$CH_2{=}\overset{\overset{CH_2COOCH_3}{|}}{\underset{\underset{COO(CH_2)_3COOC_4H_9}{|}}{C}} \qquad \text{(IV-2-6)}$$

$$CH_2{=}\overset{\overset{CH_3}{|}}{\underset{\underset{CONH(CH_2)_6COOC_8H_{17}}{|}}{C}} \qquad \text{(IV-2-7)}$$

-continued (IV-2-8)

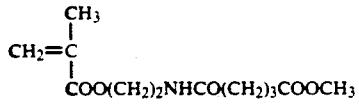

(IV-2-9)

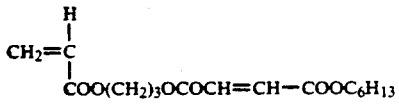

(IV-2-10)

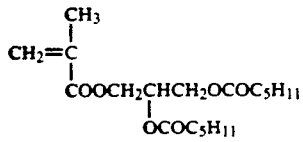

(IV-2-11)

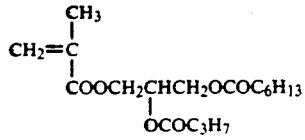

(IV-2-12)

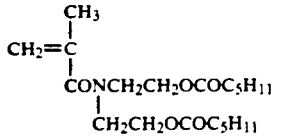

(IV-2-13)

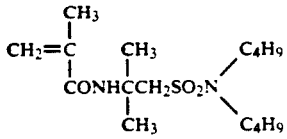

(IV-2-14)

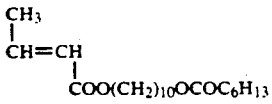

(IV-2-15)

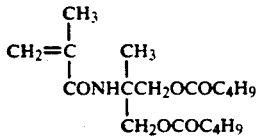

(IV-2-16)

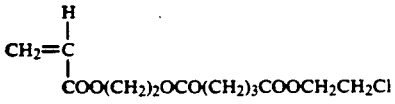

(IV-2-17)

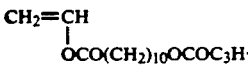

(IV-2-18)

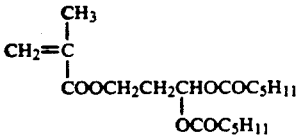

(IV-2-19)

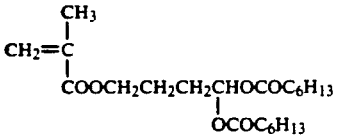

-continued (IV-2-20)

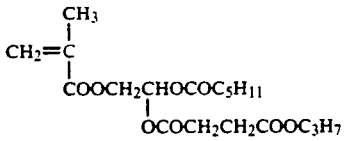

(IV-2-21)

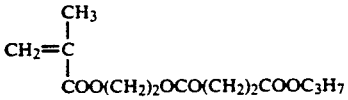

(IV-2-22)

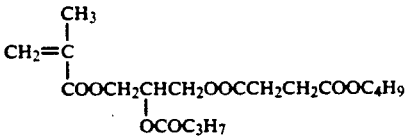

(IV-2-23)

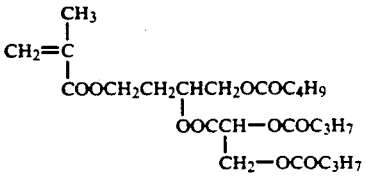

(IV-2-24)

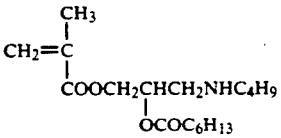

(IV-2-25)

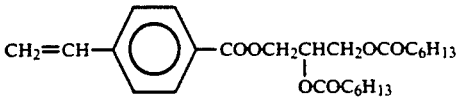

(IV-2-26)

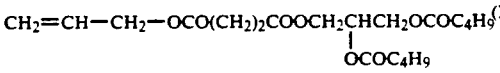

(IV-2-27)

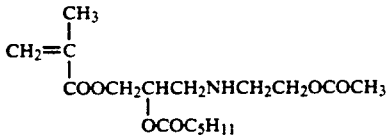

(IV-2-28)

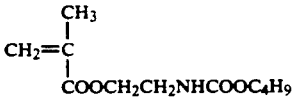

(IV-2-29)

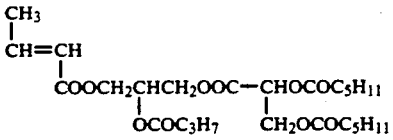

According to the above described embodiment, the dispersion resin grains in the present invention are composed of at least one kind of the mono-functional monomer (A) and at least one kind of the mono-functional monomer (B-2). It is important that the resin grains synthesized by these monomers are insoluble in the above described non-aqueous solvent in order to obtain the desired dispersion resin grains used in the present invention.

More specifically, the proportion of the monomer (B-2) represented by the general formula (IV-2) to the monomer (A) being insolubilized by the polymerization thereof is preferably from 0.1 to 10% by weight, and more preferably from 0.2 to 8% by weight.

The liquid developer for electrostatic photography according to the above described embodiment of the present invention has, by the use of the monomer (B-2) together with the mono-functional monomer (A), the feature that the developer has an excellent fixing property while keeping the good re-dispersibility.

The above described dispersion resin grains (latex grains) for use in the present invention can be prepared by polymerization with heating the monomer (A), and, if desired, the monomer (B-1) or (B-2) described above in a non-aqueous solvent in the presence of the above described dispersion-stabilizing resin using a polymerization initiator such as benzyl peroxide, azobisisobutyronitrile, or butyl lithium.

Specifically, the dispersion resin grains are obtained by (1) a method of adding a polymerization initiator to a solution containing the dispersion-stabilizing resin, the monomer (A), and, if desired, the monomer (B-1) or (B-2), (2) a method of adding dropwise a polymerization initiator together with the monomer (A) and, if desired, the monomer (B-1) or (B-2) to a solution containing the dispersion-stabilizing resin dissolved therein, (3) a method of adding to a solution containing a total amount of the dispersion-stabilizing resin and a part of the monomer (A) and, if desired, the monomer (B-1) or (B-2), the remaining monomer (A) and, if desired, the monomer (B-1) or (B-2) together with a polymerization initiator, or (4) a method of adding a solution of the dispersion-stabilizing resin, the monomer (A) and, if desired, the monomer (B-1) or (B-2) to a non-aqueous solvent together with a polymerization initiator.

The total amount of the monomer (A) and the monomer (B-1) or (B-2), if desired, is from 5 to 80 parts by weight, and preferably from 10 to 50 parts by weight, per 100 parts by weight of the non-aqueous solvent.

The proportion of the soluble resin which is the dispersion-stabilizing resin is from 1 to 100 parts by weight, and preferably from 5 to 50 parts by weight per 100 parts by weight of the total monomers.

The proper amount of the polymerization initiator is from 0.1 to 5% by weight of the amount of the total monomers.

The polymerization temperature is from about 50° to 180° C., and preferably from 60° to 120° C. and the reaction time is preferably from 1 to 15 hours.

When the above described polar solvent such as an alcohol, a ketone, an ether, or an ester is used in the non-aqueous solvent in the reaction, or unreacted monomers (A), (B-1) or (B-2) remain without being polymerization granulated, it is preferred to remove the polar solvent and/or the unreacted monomers by heating above the boiling point of the polar solvent or monomers, or by distillation under reduced pressure.

The weight average molecular weight of the dispersion resin grains of the present invention is from $1\times10^3$ to $1\times10^6$, and preferably from $1\times10^4$ to $5\times10^5$.

The non-aqueous system dispersion resin grains latex grains) thus produced as described above exist as fine grains having a uniform grain size distribution and has a very stable dispersibility. In particular, when the liquid developer containing the dispersed resin grains is used repeatedly in a developing apparatus for a long period of time, the resin grains keep the good dispersibility and further, when the developing speed is increased, the resin grains can be easily re-dispersed and no stain on each part of the developing apparatus by adhesion of the resin grains is observed.

Also, when the resin grains are fixed by heating, etc., a strong film or coating is formed, which indicates an excellent fixing property of the resin.

Moreover, the liquid developer of the present invention is excellent in dispersion stability, re-dispersibility, and fixing property even when the liquid developer is used in a quickened development-fixing step with a prolonged interval period of the maintenances.

Furthermore, the liquid developer of the present invention is excellent in dispersibility, re-dispersibility, and fixing property even when the developing-fixing steps are quickened and large-size master plates are used for making printing plates.

The liquid developer for electrophotography of the present invention may contain, if desired, a coloring agent. There is no specific restriction on the coloring agent being used, and any conventional pigments or dyes can be used as the coloring agent in the present invention.

In the case of coloring the dispersion resin grains per se, there is a method of physically dispersing a pigment or a dye in the dispersion resin grains and various pigments and dyes are known for the purpose. For example, there are a magnetic iron oxide powder, powdered lead iodide, carbon black, nigrosine, Alkali Blue, Hanza Yellow, Quinacridone Red, and Phthalocyanine Blue.

As another method of coloring the dispersion resin grains, there is a method of dyeing the dispersion resin grains with a desired dye as described, for example, in JP-A-57-48738. Also, as still another method, there is a method of chemically bonding the dispersion resin and a dye as disclosed, for example, in JP-A-53-54029 or a method of using a monomer previously containing a dye in the production of polymer by a polymerization granulation to form a copolymer containing the dye as described, for example, in JP-B-44-22955.

The liquid developer of the present invention may further contain, if desired, various additives for improving the charging characteristics and image characteristics as described, for example, in Yuji Harasaki, *Denshi Shashin* (*Electrophotography*), Vol. 16, No. 2, page 44.

For example, as charge controlling agents, there are metal salts of di-2-ethylhexylsulfosuccinic acid, metal salts of naphthenic acid, metal salts of a higher fatty acid, lecithin, poly(vinylpyrrolidone), and a copolymer containing a half maleic acid amide component.

Now, the amounts of the main components of the liquid developer of the present invention are explained below.

The amount of the toner grains (resin grains) mainly composed of the resin and, if desired, a coloring agent is preferably from 0.5 to 50 parts by weight per 1,000 parts by weight of the liquid carrier.

If the amount is less than 0.5 part by weight, the resisting property of the toner decreases when the liquid developer is applied to printing plates thereby resulting in the decrease in the image quality of prints and the printing durability. Also, when the toner grains contain a coloring agent, the use of the toner in a proportion of less than 0.5 part by weight causes an insufficient image density. On the other hand, if the amount exceeds 50 parts by weight, background stains tend to form on the prints when the liquid development is applied to printing plates, and, if the toner grains contain a coloring agent, fog tends to form on non-image portions.

Further, the above described dispersion-stabilizing resin soluble in the liquid carrier is additionally used, if desired, and the amount thereof is from about 0.5 to 100 parts by weight to 1,000 parts by weight of the liquid carrier.

Also, a charge controlling agent may be used in an amount of preferably from 0.001 to 1.0 part by weight per 1,000 parts by weight of the liquid carrier.

Moreover, if desired, various additives may be added and the upper limit of the total amount of these additives is regulated by the electric resistance of the liquid developer obtained. More specifically, if the electric resistance of the liquid developer in a state of excluding the toner grains is lower than $10^9$ Ω cm, image having good continuous tone is reluctant to obtain and hence it is necessary to control the addition amount of each additive within the above described limit.

The present invention will now be illustrated in greater detail with reference to the following synthesis examples of dispersion-stabilizing resin, synthesis examples of latex grains and examples, but it should be understood that the present invention is not to be construed as being limited thereto.

SYNTHESIS EXAMPLE M-1

Synthesis of Macromonomer (MM-1)

A mixed solution of 90 g of lauryl methacrylate, 10 g of 2-hydroxyethyl methacrylate, 5 g of thioglycolic acid and 200 g of toluene was heated to 75° C. with stirring in a nitrogen stream and, after adding thereto 1.0 g of 2,2-azobisisobutyronitrile (hereinafter abbreviated as AIBN), the reaction was carried out for 8 hours. Then, to the reaction mixture were added 8 g of glycidyl methacrylate, 1.0 g of N,N-dimethyldodecylamine and 0.5 g of tert-butylhydroquninone, and the resulting mixture was stirred for 12 hours at 100° C. After cooling, the reaction mixture was reprecipitated from 2 liters of n-hexane to obtain 82 g of the desired macromonomer (MM-1) as a white powder. The weight average molecular weight of the macromonomer obtained was $3.8\times10^3$.

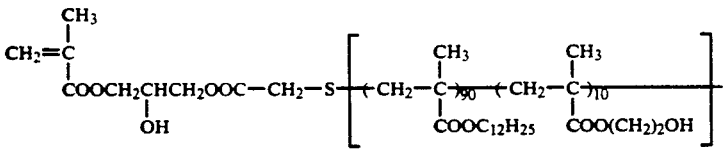

(MM-1)

SYNTHESIS EXAMPLE M-2

Synthesis of Macromonomer (MM-2)

A mixed solution of 90 g of butyl methacrylate, 10 g of methacrylic acid, 4 g of 2-mercaptoethanol, and 200 g of tetrahydrofuran was heated to 70° C. in a nitrogen stream and, after adding thereto 1.2 g of AIBN, the reaction was carried out for 8 hours.

Then, after cooling the reaction mixture in a water bath to 20° C., 10.2 g of triethylamine was added to the reaction mixture, and then 14.5 g of methacrylic acid chloride was added dropwise to the mixture with stirring at a temperature below 25° C. Thereafter, the resulting mixture was further stirred for one hour. Then, after adding thereto 0.5 g of tert-butylhydroquinone, the mixture was heated to 60° C. and stirred for 4 hours. After cooling, the reaction mixture was added dropwise to one liter of water with stirring over a period of about 10 minutes, and the mixture was stirred for one hour. Then, the mixture was allowed to stand and water was removed by decantation. The mixture was washed twice with water and, after dissolving it in 100 ml of tetrahydrofuran, the solution was reprecipitated from 2 liter of petroleum ether. The precipitates thus formed were collected by decantation and dried under reduced pressure to obtain 65 g of the desired macromonomer as a viscous product. The weight average molecular weight of the product was $5.6\times10^3$.

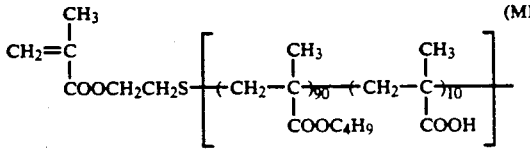

(MM-2)

SYNTHESIS EXAMPLE M-3

Synthesis of Macromonomer (MM-3)

A mixed solution of 95 g of benzyl methacrylate, 5 g of 2-phosphonoethyl methacrylate, 4 g of 2-aminoethylmercaptan, and 200 g of tetrahydrofuran was heated to 70° C. with stirring in a nitrogen stream.

Then, after adding 1.5 g of AIBN to the reaction mixture, the reaction was carried out for 4 hours and, after further adding thereto 0.5 g of AIBN, the reaction was carried out for 4 hours. Then, the reaction mixture was cooled to 20° C. and, after adding thereto 10 g of acrylic acid anhydride, the mixture was stirred for one hour at a temperature of from 20° C. to 25° C. Then, 1.0 g of tert-butylhydroquinone was added to the reaction mixture, and the resulting mixture was stirred for 4 hours at a temperature of from 50° C. to 60° C. After cooling, the reaction mixture was added dropwise to one liter of water with stirring over a period of about 10 minutes followed by stirring for one hour. The mixture was allowed to stand, and then water was removed by decantation. The product was washed twice with water, dissolved in 100 ml of tetrahydrofuran and the solution was reprecipitated from 2 liters of petroleum ether. The precipitates formed were collected by decantation and dried under reduced pressure to obtain 70 g of the desired macromonomer as a viscous product. The weight average molecular weight was $5.5\times10^3$.

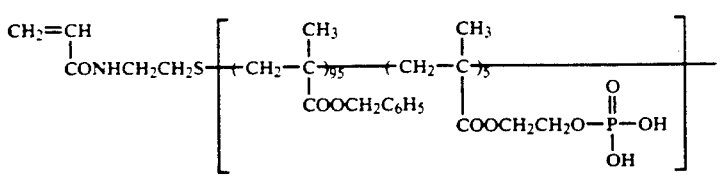

(MM-3)

SYNTHESIS EXAMPLE M-4

Synthesis of Macromonomer (MM-4)

A mixed solution of 90 g of dodecyl methacrylate, 10 g of Monomer (I) having the structure shown below, 4 g of thioglycolic acid and 200 g of toluene was heated to 70° C. in a nitrogen stream.

Monomer (I)

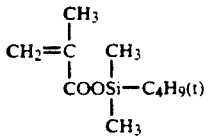

Then, 1.5 g of AIBN was added to the reaction mixture, and the reaction was carried out for 5 hours. After further adding thereto 0.5 g of AIBN, the reaction was carried out for 4 hours. Then, after adding thereto 12.4 g of glycidyl methacrylate, 1.0 g of N,N-dimethyldodecylamine, and 1.5 g of tert-butylhydroquinone, the reaction was carried out for 8 hours at 110° C. After cooling, the reaction mixture was added to a mixture of 3 g of p-toluenesulfonic acid and 100 ml of an aqueous solution of 90% by volume tetrahydrofuran, and the mixture was stirred for one hour at a temperature of from 30° C. to 35° C. The reaction mixture obtained was reprecipitated from 2 liters of a mixture of water and ethanol (⅓ by volume ratio), and the precipitates thus formed were collected by decantation and dissolved in 200 ml of tetrahydrofuran. The solution was reprecipitated from 2 liters of n-hexane to obtain 58 g of the desired macromonomer (MM-4) as powder. The weight average molecular weight thereof was $7.6\times10^3$.

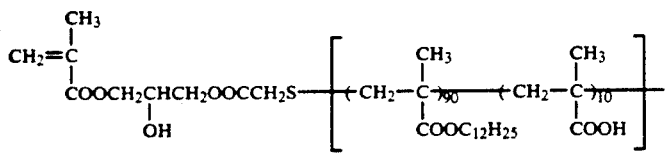

(MM-4)

SYNTHESIS EXAMPLE M-5

Synthesis of Macromonomer (MM-5)

A mixed solution of 95 g of octadecyl methacrylate, 5 g of 3-(2'-nitrobenzyloxysulfonyl)propyl methacrylate, 150 g of toluene and 50 g of isopropyl alcohol was heated to 80° C. in a nitrogen stream. Then, after adding 5.0 g of 4,4'-azobis(4-cyanovaleric acid) (hereinafter abbreviated as ACV) to the reaction mixture, the reaction was carried out for 5 hours and, after further adding thereto 1.0 g of ACV, the reaction was carried out for 4 hours. After cooling, the reaction mixture was reprecipitated from 2 liters of methanol and the powder thus formed was collected and dried under reduced pressure.

A mixture of 50 g of the powder obtained in the above step, 14 g of glycidyl methacrylate, 0.6 g of N,N,-dimethyldodecylamine, 1.0 g of tert-butylhydroquinone, and 100 g of toluene was stirred for 10 hours at 110° C. After cooling to room temperature, the reaction mixture was irradiated with a high pressure mercury lamp of 80 watts with stirring for one hour. Thereafter, the reaction mixture was reprecipitated from one liter of methanol, and the powder formed was collected by filtration and dried under reduced pressure to obtain 34 g of the desired macromonomer (MM-5). The weight average molecular weight of the product was $7.3\times10^3$.

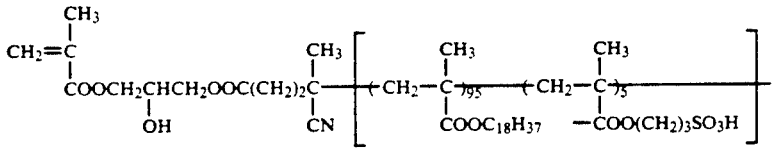

(MM-5)

SYNTHESIS EXAMPLE P-1

Synthesis of Dispersion-Stabilizing Resin (P-1)

A mixed solution of 70 g of stearyl methacrylate, 30 g of Macromonomer (MM-2) obtained in Synthesis Example M-2, and 100 g of toluene was heated to 75° C. in a nitrogen stream. After adding 1.5 g of AIBN to the reaction mixture, the reaction was carried out for 4 hours and, after further adding thereto 0.5 g of AIBN, the reaction was carried out for 3 hours. Then, the reaction mixture was reprecipitated from 3 liters of methanol, and the powder thus precipitated was collected by filtration and dried under reduced pressure to obtain 85 g of the desired resin (P-1) which had a weight average molecular weight of $3.9\times10^4$.

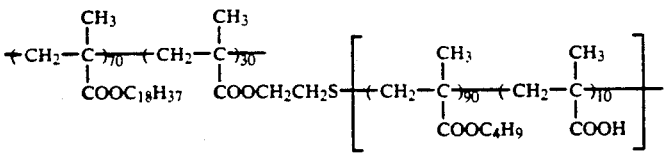

(P-1)

SYNTHESIS EXAMPLE P-2

Synthesis of Dispersion-Stabilizing Resin (P-2)

A mixed solution of 65 g of lauryl methacrylate, 15 g of tert-butyl methacrylate, 20 g of Macromonomer (MM-1) obtained in Synthesis Example M-1, and 200 g of toluene was heated to 70° C. in a nitrogen stream and, after adding thereto 1.0 g of AIBN, the reaction was carried out for 4 hours. Then, 0.5 g of AIBN was added to the reaction mixture, and the reaction was carried out for 2 hours and after further adding 0.3 g of AIBN, the reaction was further carried out for 3 hours to obtain the desired resin (P-2). The weight average molecular weight of the copolymer was $3.6\times10^4$.

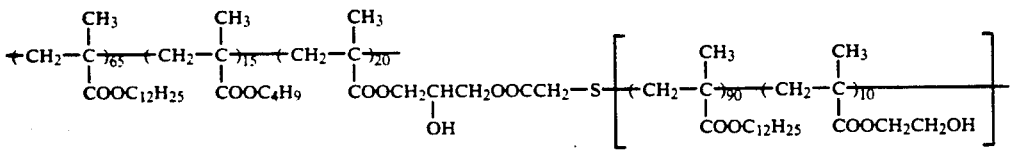

(P-2)

SYNTHESIS EXAMPLE P-3

Synthesis of Dispersion-Stabilizing Resin (P-3)

A mixed solution of 75 g of lauryl methacrylate, 25 g of Macromonomer (MM-4) obtained in Synthesis Example M-4, and 200 g of toluene was heated to 85° C. in a nitrogen stream. Then, 1.0 of ACV was added to the reaction mixture, and the reaction was carried out for 5 hours and, after further adding thereto 0.3 g of ACV, the reaction was carried out for 4 hours to obtain the desired resin (P-3). The weight average molecular weight of the copolymer was $4.8\times10^4$.

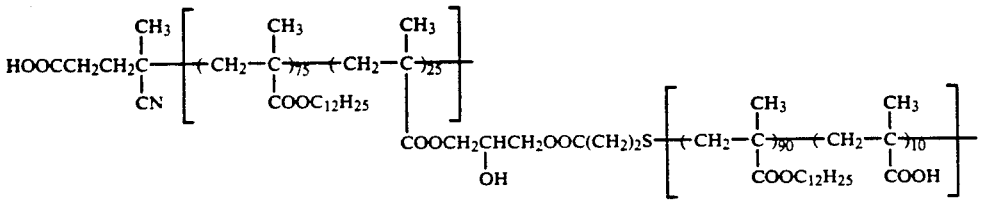

(P-3)

SYNTHESIS EXAMPLES P-4 TO P-11

Synthesis of Dispersion-Stabilizing Resins (P-4) to (P-11)

Dispersion-Stabilizing Resins shown in Table 1 below were synthesized in the same manner as described in Synthesis Example P-2 except for using the corresponding compounds shown in Table 1 below in place of lauryl methacrylate, tert-butyl methacrylate and Macromonomer (MM-1), respectively. The weight average molecular weight of each resin was in a range of from $3.5\times10^4$ to $5.0\times10^4$.

TABLE 1

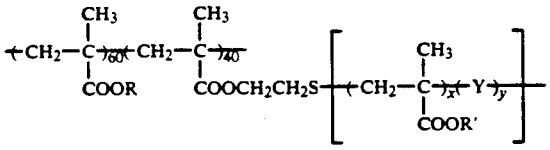

| Synthesis Example No. | Resin (P) | R | R' | x/y (weight ratio) | —Y— |
|---|---|---|---|---|---|
| P-4 | (P-4) | $-C_{12}H_{25}$ | $-C_{12}H_{25}$ | 90/10 | $-CH_2-CH(COOH)-$ |
| P-5 | (P-5) | $-C_{12}H_{25}$ | $-C_4H_9$ | 85/15 | $-CH_2-C(CH_3)(COO(CH_2)_2OCO(CH_2)_3COOH)-$ |

TABLE 1-continued

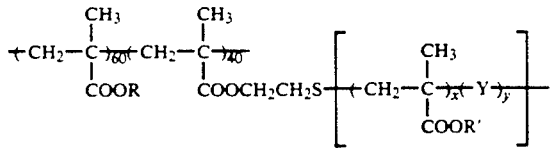

| Synthesis Example No. | Resin (P) | R | R' | x/y (weight ratio) | —Y— |
|---|---|---|---|---|---|
| P-6 | (P-6) | $-C_{18}H_{37}$ | 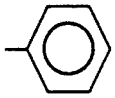 | 90/10 | 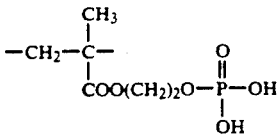 |
| P-7 | (P-7) | $-C_{18}H_{37}$ | $-CH_3$ | 90/10 | $-CH_2-CH-$ <br> $\lvert$ <br> $COOCH_2CH_2COOH$ |
| P-8 | (P-8) | $-C_{16}H_{33}$ | $-CH_2CHCH_2OCOCH_3$ <br> $\lvert$ <br> $OCOCH_3$ | 90/10 | 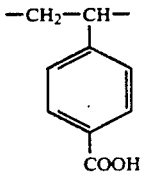 |
| P-9 | (P-9) | $-C_8H_{17}$ | $-C_{18}H_{37}$ | 92/8 | $CH_3$ <br> $-CH_2-C-$ <br> $\lvert$ <br> $COO(CH_2)_3SO_3H$ |
| P-10 | (P-10) | $-C_6H_{13}$ | $-(CH_2)_2OCOCC_{11}H_{23}$ | 93/7 | $COOH$ <br> $-CH_2-C-$ <br> $\lvert$ <br> $CH_2COOH$ |
| P-11 | (P-11) | $-CH_3$ | $-C_{18}H_{37}$ | 90/10 | 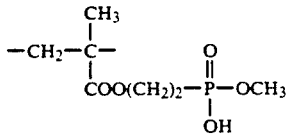 |

SYNTHESIS EXAMPLES P-12 TO P-19

Synthesis of Dispersion-Stabilizing Resins (P-12) to (P-19)

Dispersion-Stabilizing Resins shown in Table 2 below were synthesized in the same manner as described in Synthesis Example P-3, except for using the corresponding compounds as shown in Table 2 below in place of lauryl methacrylate, Macromonomer (MM-4) and ACV, respectively. The weight average molecular weight of each resin was in a range of from $3\times10^4$ to $6\times10^4$.

TABLE 2

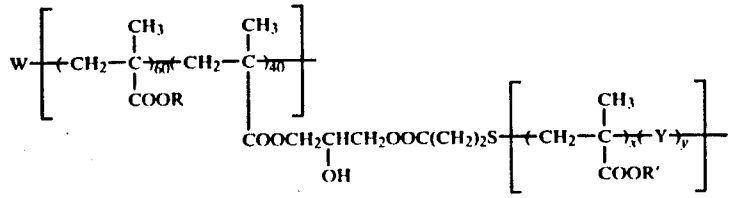

| Synthesis Example No. | Resin (P) | W— | R | R' | x/y (weight ratio) | —Y— |
|---|---|---|---|---|---|---|
| P-12 | (P-12) | $HOOC(CH_2)_3C(CH_3)(CN)$— | $-C_{18}H_{37}$ | $-C_2H_5$ | 90/10 | $-CH_2-C(CH_3)(COO(CH_2)_2OH)$— |
| P-13 | (P-13) | $HO(CH_2)_7C(CH_3)(CN)$— | $-C_{12}H_{25}$ | $-CH_2CH(OCOCH_3)CH_2OCOCH_3$ | 85/15 | $-CH_2-C(CH_3)(COO(CH_2)_6OH)$— |
| P-14 | (P-14) | $HOOC-CH_2$ / $HOOC-CH-OOC(CH_2)_3C(CH_3)(CN)$— | $-C_{16}H_{33}$ | $-CH_2-C_6H_5$ | 90/10 | $-CH_2-C(CH_3)(CONHCH(CH_2OH)CH_2OH)$— |
| P-15 | (P-15) | $HO-P(=O)(OH)-OCH_2CH_2S$— | $-C_2H_5$ | $-C_{18}H_{37}$ | 92/8 | $-CH_2-C(CH_3)(COOCH_2CH(OH)CH_2OH)$— |
| P-16 | (P-16) | 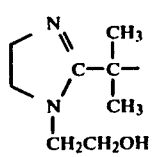 | $-C_4H_9$ | $-C_{16}H_{33}$ | 93/7 | $-CH_2-C(CH_3)(COO(CH_2)_2OCO(CH_2)_2COOH)$— |
| P-17 | (P-17) | $HOH_2C-C(CH_2OH)_2-NHCO-C(CH_3)_2$— | $-C_{12}H_{25}$ | $-COOCH_2CH(OCOC_5H_{11})CH_2OCOC_5H_{11}$ | 92/8 | $-CH_2-C(CH_3)(COO(CH_2)_2O-P(=O)(OH)-OH)$— |

TABLE 2-continued
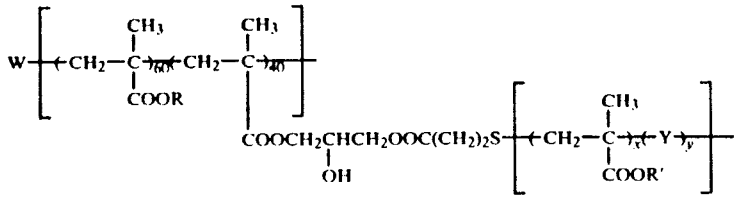
| Synthesis Example No. | Resin (P) | W— | R | R' | x/y (weight ratio) | —Y— |
|---|---|---|---|---|---|---|
| P-18 | (P-18) | 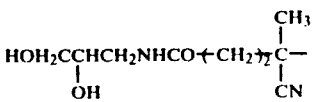 | $-C_2H_5$ | $+CH_2)_2OCOC_{11}H_{23}$ | 95/5 | 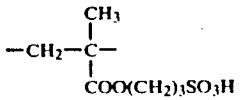 |
| P-19 | (P-19) | 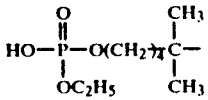 | 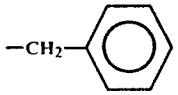 | $-C_{18}H_{37}$ | 80/20 | 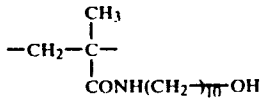 |

SYNTHESIS EXAMPLE D-1

Synthesis of Latex Grain (D-1)

A mixture of 100 g of vinyl acetate, 12 g of Dispersion-Stabilizing Resin (P-1), and 380 g of Isopar H was heated to 75° C. with stirring under nitrogen gas stream. After adding 0.8 g of A.I.B.N. to the reaction mixture, the reaction was carried out for 4 hours and, after further adding thereto 0.4 g of A.I.B.N., the reaction was carried out for 2 hours. Twenty minutes after the addition of the polymerization initiator, the reaction mixture became white turbid, and the reaction temperature raised to 88° C. In this point, 8 g of Dispersion-Stabilizing Resin (P-1) was added thereto and, after raising the temperature to 100° C., the mixture was stirred for one hour to distill off unreacted vinyl acetate. After cooling, the reaction mixture was passed through a 200 mesh nylon cloth to obtain the desired latex grains having a mean grain size of 0.20 μm with a polymerization ratio of 90% as a white dispersion.

SYNTHESIS EXAMPLES D-2 TO D-19

Synthesis of Latex Grains (D-2 to D-29)

By following the same procedure as Synthesis Example D-1 except that each of the compounds shown in Table 3 below was used in place of Dispersion-Stabilizing Resin (P-1), each of the latex grains shown in Table 3 below was produced.

The polymerization ratios of the latex grains thus obtained were from 80% to 85%.

TABLE 3

| Synthesis Example No. | Latex Grain | Dispersion-Stabilizing Resin Kind | Dispersion-Stabilizing Resin Amount Used (g) | Mean Grain Size of Latex Grain (μm) |
|---|---|---|---|---|
| 2 | (D-2) | (P-2) | 10 | 0.30 |
| 3 | (D-3) | (P-3) | 8 | 0.18 |
| 4 | (D-4) | (P-4) | 10 | 0.25 |
| 5 | (D-5) | (P-5) | 12 | 0.28 |
| 6 | (D-6) | (P-6) | 14 | 0.25 |
| 7 | (D-7) | (P-7) | 10 | 0.23 |
| 8 | (D-8) | (P-8) | 12 | 0.22 |
| 9 | (D-9) | (P-9) | 10 | 0.23 |
| 10 | (D-10) | (P-10) | 8 | 0.26 |
| 11 | (D-11) | (P-11) | 10 | 0.19 |
| 12 | (D-12) | (P-12) | 14 | 0.27 |
| 13 | (D-13) | (P-13) | 14 | 0.25 |
| 14 | (D-14) | (P-14) | 12 | 0.24 |
| 15 | (D-15) | (P-15) | 16 | 0.26 |
| 16 | (D-16) | (P-16) | 8 | 0.19 |
| 17 | (D-17) | (P-17) | 10 | 0.18 |
| 18 | (D-18) | (P-18) | 12 | 0.22 |
| 19 | (D-19) | (P-19) | 8 | 0.27 |

SYNTHESIS EXAMPLE D-20

Synthesis of Latex Grain (D-20)

A mixture of 100 g of vinyl acetate, 5 g of crotonic acid, 12 g of Dispersion-Stabilizing Resin (P-3), and 468 g of Isopar E was heated to 70° C. with stirring under nitrogen gas stream. Then, 1.3 g of 2,2'-azobis-(isovaleronitrile) (hereinafter abbreviated as AIVN) was added to the reaction mixture which was then reacted for 6 hours. The temperature of the system was raised to 100° C., and the mixture was stirred for one hour at the temperature to distill off the remaining vinyl acetate. After cooling, the reaction mixture was passed through a 200 mesh nylon cloth to obtain the desired latex grains having a mean grain size of 0.24 μm with a polymerization ratio of 85% as a white dispersion.

SYNTHESIS EXAMPLE D-21

Synthesis of Latex Grain (D-21)

A mixture of 12 g of Dispersion-Stabilizing Resin (P-11), 100 g of vinyl acetate, 6.0 g of 4-pentenoic acid, and 380 g of Isopar G was heated to 75° C. with stirring under nitrogen gas stream. Then, after adding 0.7 g of AIBN to the reaction mixture, the reaction was carried out for 4 hours and, after further adding thereto 0.5 g of AIBN, the reaction was carried out for 2 hours. After cooling, the reaction mixture was passed through a 200 mesh nylon cloth to obtain the desired latex grains having a mean grain size of 0.24 μm as a white dispersion.

SYNTHESIS EXAMPLE D-22

Synthesis of Latex Grain (D-22)

A mixture of 85 g of vinyl acetate, 15 g of N-vinylpyrrolidone, 12 g of Dispersion-Stabilizing Resin (P-19), and 380 g of n-decane was heated to 75° C. with stirring under nitrogen gas stream. Then, after adding 1.7 g of AIBN to the reaction mixture, the reaction was carried out for 4 hours and, after further adding thereto 0.5 g of AIBN, the reaction was carried out for 2 hours. After cooling, the reaction mixture was passed through a 200 mesh nylon cloth to obtain the desired latex grains having a mean grain size of 0.26 μm as a white dispersion.

SYNTHESIS EXAMPLE D-23

Synthesis of Latex Grain (D-23)

A mixture of 100 g of methyl methacrylate, 16 g of Dispersion-Stabilizing Resin (P-13), and 470 g of n-decane was heated to 70° C. with stirring under nitrogen gas stream and, after adding 1.0 g of AIVN to the reaction mixture, the reaction was carried out for 2 hours. Few minutes after the addition of the polymerization initiator, the mixture began to become blue-white turbid, and the reaction temperature raised to 90° C. After cooling, the reaction mixture was passed through a 200 mesh nylon cloth to remove coarse grains, whereby the desired latex grains having a mean grain size of 0.35 μm were obtained as a white dispersion.

SYNTHESIS EXAMPLE D-24

Synthesis of Latex Grain (D-24)

A mixture of 100 g of styrene, 8 g of Dispersion-Stabilizing Resin (P-2), and 380 g of Isopar H was heated to 60° C. with stirring under nitrogen gas stream. Then, after adding 0.6 g of AIVN to the reaction mixture, the reaction was carried out for 4 hours and, after further adding thereto 0.3 g of AIVN, the reaction was carried out for 3 hours. After cooling, the reaction mixture was passed through a 200 mesh nylon cloth to obtain the desired latex grain having a mean grain size of about 0.20 μm as a white dispersion.

SYNTHESIS EXAMPLE D-25

Synthesis of Latex Grain for Comparison (A-1)

By following the same procedure as Synthesis Example D-1 except that 20 g of poly(octadecyl methacrylate) was used in place of Dispersion-Stabilizing Resin (P-1) (12 g) and the post-added dispersion-stabilizing resin P-4 (8 g), latex grains having a mean grain size of 0.25 μm were obtained with a polymerization ratio of 85% as a white dispersion.

SYNTHESIS EXAMPLE D-26

Synthesis of Latex Grain for Comparison (B-1)

By following the same procedure as Synthesis Example D-1 except for using a mixture of 20 g of poly(octadecyl methacrylate), 100 g of vinyl acetate, 1.0 g of octadecyl methacrylate, and 385 g of Isopar H, latex grains having a mean grain size of 0.20 μm were obtained with a polymerization ratio of 85% as a white dispersion. (Latex grains described in JP-A-60-179751).

SYNTHESIS EXAMPLE D-27

Synthesis of Latex Grain for Comparison (C-1)

By following the same procedure as Synthesis Example D-1 except for using a mixture of 20 g of poly(octadecyl methacrylate), 100 g of vinyl acetate, 1 g of Monomer (I) having the chemical structure shown below, and 385 g of Isopar H, latex grains having a mean grain size of 0.24 μm were obtained with a polymerization ratio of 86% as a white dispersion. (Latex grains described in JP-A-62-151868).

Monomer (I)

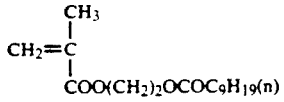

SYNTHESIS EXAMPLE D-28

Synthesis of Latex Grain (D-28)

A mixture of 12 g of Dispersion-Stabilizing Resin (P-1), 100 g of vinyl acetate, 1.0 g of octadecyl methacrylate, and 384 g of Isopar H was heated to 70° C. with stirring under nitrogen gas stream and, after adding 0.8 g of AIVN to the reaction mixture, the reaction was carried out for 6 hours. Twenty minutes after the addition of the polymerization initiator, the mixture became white turbid and the reaction temperature raised to 88° C. Then, the mixture was stirred for 2 hours at 100° C. to distill off the unreacted vinyl acetate. After cooling, the reaction mixture was passed through a 200 mesh nylon cloth to obtain the desired latex grain having a mean grain size of 0.24 μm with a polymerization ratio of 90% as a white dispersion.

SYNTHESIS EXAMPLES D-29 TO D-39

Synthesis of Latex Grains (D-29) to (D-39)

By following the same procedure as Synthesis Example D-28 except that each of the dispersion-stabilizing resins shown in Table 4 below was used in place of Dispersion-Stabilizing Resin (P-1), each of Latex Grains (D-29) to (D-39) was produced.

TABLE 4

| Synthesis Example No. | Latex Grain | Dispersion-Stabilizing Resin | Latex Grain: Polymerization Ratio (%) | Latex Grain: Mean Grain Size (μm) |
|---|---|---|---|---|
| 29 | (D-29) | (P-2) | 88 | 0.25 |
| 30 | (D-30) | (P-3) | 89 | 0.24 |
| 31 | (D-31) | (P-4) | 87 | 0.26 |
| 32 | (D-32) | (P-5) | 90 | 0.24 |
| 33 | (D-33) | (P-6) | 85 | 0.23 |

TABLE 4-continued

| Synthesis Example No. | Latex Grain | Dispersion-Stabilizing Resin | Latex Grain: Polymerization Ratio (%) | Latex Grain: Mean Grain Size (μm) |
|---|---|---|---|---|
| 34 | (D-34) | (P-7) | 86 | 0.25 |
| 35 | (D-35) | (P-8) | 85 | 0.23 |
| 36 | (D-36) | (P-9) | 88 | 0.24 |
| 37 | (D-37) | (P-12) | 83 | 0.22 |
| 38 | (D-38) | (P-15) | 86 | 0.28 |
| 39 | (D-39) | (P-18) | 86 | 0.22 |

SYNTHESIS EXAMPLES D-40 TO D-45

Synthesis of Latex Grains (D-40) to (D-45)

By following the same procedure as Synthesis Example D-28 except that 1g of each of the monomers shown in Table 5 below was used in place of 1 g of octadecyl metharylate, each of the latex grains shown in Table 5 produced.

TABLE 5

| Synthesis Example No. | Latex Grain | Monomer | Latex Grain: Polymerization Ratio (%) | Latex Grain: Mean Grain Size (μm) |
|---|---|---|---|---|
| 40 | (D-40) | Docosanyl Methacrylate | 87 | 0.23 |
| 41 | (D-41) | Hexadecyl Methacrylate | 87 | 0.24 |
| 42 | (D-42) | Tetradecyl Methacrylate | 88 | 0.24 |
| 43 | (D-43) | Tridecyl Methacrylate | 86 | 0.24 |
| 44 | (D-44) | Dodecyl Methacrylate | 86 | 0.23 |
| 45 | (D-45) | Decyl Methacrylate | 87 | 0.26 |

SYNTHESIS EXAMPLE D-46

Synthesis of Latex Grain (D-46)

A mixture of 6 g of Dispersion-Stabilizing Resin (P-10), 8 g of poly(octadecyl methacrylate), 100 g of vinyl acetate. 0.8 g of dodecyl methacrylate, and 400 g of Isopar H was heated to 75° C. with stirring under nitrogen gas stream. After adding 0.7 g of AIBN to the reaction mixture, the reaction was carried out for 4 hours and, after further adding thereto 0.5 g of AIBN, the reaction was carried out for 2 hours. After cooling, the reaction mixture was passed through a 200 mesh nylon cloth to obtain the desired latex grains having a mean grain size of 0.20 μm as a white dispersion.

SYNTHESIS EXAMPLE D-47

Synthesis of Latex Grain (D-47)

A mixture of 14 g of Dispersion-Stabilizing Resin (P-16), 90 g of vinyl acetate, 10 g of N-vinylpyrrolidone, 1.5 g of octadecyl methacrylate, and 400 g of isododecane was heated to 65° C. with stirring under nitrogen gas stream and, after adding 1.5 g of AIBN to the reaction mixture, the reaction was carried out for 4 hours. After cooling, the reaction mixture was passed through a 200 mesh nylon cloth to obtain the desired latex grains having a mean grain size of 0.25 μm as a white dispersion.

SYNTHESIS EXAMPLE D-48

Synthesis of Latex Grain (D-48)

A mixture of 16 g of Dispersion-Stabilizing Resin (P-4), 94 g of vinyl acetate, 6 g of crotonic acid, 2 g of hexadecyl methacrylate, and 380 g of Isopar G was heated to 60° C. with stirring under nitrogen gas stream. After adding 1.0 g of AIVN to the reaction mixture, the reaction was carried out for 2 hours and, after further adding thereto 0.5 g of AIVN, the reaction was carried out for 2 hours. After cooling, the reaction mixture was passed through a 200 mesh nylon cloth to obtain the desired latex grains having a mean grain size of 0.24 μm as a white dispersion.

SYNTHESIS EXAMPLE D-49

Synthesis of Latex Grain (D-49)

A mixture of 25 g of Dispersion-Stabilizing Resin (P-15), 100 g of methyl methacrylate, 2 g of decyl methacrylate, 0.8 g of n-dodecylmercaptane, and 370 g of Isopar H was heated to 60° C. with stirring under nitrogen gas stream and, after adding 0.7 g of AIVN to the reaction mixture, the reaction was carried out for 4 hours. After cooling, the reaction mixture was passed through a 200 mesh nylon cloth to obtain the desired latex grains having a mean grain size of 0.25 μm as a white dispersion.

SYNTHESIS EXAMPLE D-50

Synthesis of Latex Grain (D-50)

A mixture of 20 g of Dispersion-Stabilizing Resin (P-19), 100 g of styrene, 2 g of octadecyl vinyl ether, and 380 g of Isopar H was heated to 45° C. with stirring under nitrogen gas stream and, after adding 1.0 g (a solid content as n-butyl lithium) of a hexane solution of n-butyl lithium to the reaction mixture, the reaction was carried out for 4 hours. After cooling, the reaction mixture was passed through a 200 mesh nylon cloth to obtain the desired latex grains having a mean grain size of 0.27 μm as a white dispersion.

SYNTHESIS EXAMPLE D-51

Synthesis of Latex Grain for Comparison (A-2)

By following the same procedure as Synthesis Example D-28 except for using a mixture of 20 g of poly(octadecyl methacrylate) (Dispersion-Stabilizing Resin (R-1)), 100 g of vinyl acetate, 1 g of octadecyl methacrylate, and 380 g of Isopar H, latex grains having a mean grain size of 0.27 μm were obtained with a polymerization ratio of 88% as a white dispersion. (Latex grains described in JP-A-60-17951),

SYNTHESIS EXAMPLE D-52

Synthesis of Latex Grain for Comparison (B-2)

A mixture of 97 g of octadecyl methacrylate, 3 g of acrylic acid, and 200 g of toluene was heated to 75° C. with stirring under nitrogen gas stream and, after adding 1.0 g of AIBN to the reaction mixture, the reaction was carried out for 8 hours. Then, 12 g of glycidyl methacrylate, 1.0 g of tert-butylhydroquinone, and 1.2 g of N,N-dimethyldodecylamine were added to the reaction mixture, and the resulting mixture was stirred for 40 hours at 100° C. After cooling, the reaction mixture was reprecipitated from 2 liters of methanol, and the white powder formed was collected by filtration and dried to obtain 84 g of Dispersion-Stabilizing Resin (R-2) having the following structure. The weight average molecular weight thereof was 35,000.

Dispersion-Stabilizing Resin (R-2)

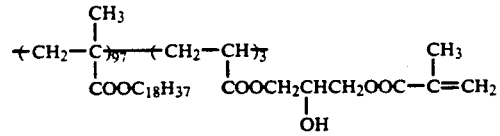

(weight composition ratio)

Then, by following the same procedure as in Synthesis Example D-28 except for using a mixture of 10 g of the dispersion-stabilizing resin R-2, 100 g of vinyl acetate, 1.0 g of octadecyl methacrylate, and 384 g of Isopar H, latex grains having a mean grain size of 0.15 μm were obtained with a polymerization ratio of 89% as a white dispersion. (Latex grains described in JP-A-61-63855).

SYNTHESIS EXAMPLE D-53

Synthesis of Latex Grain for Comparison (C-2)

By following the same procedure as Synthesis Example D-28 except for using a mixture of 12 g of Dispersion-Stabilizing Resin (R-3) having the structure shown below, which was produced by the method as described in JP-A-60-185963, 100 g of vinyl acetate, 1.0 g of octadecyl methacrylate, and 382 g of Isopar H, latex grains having a mean grain size of 0.23 μm were obtained with a polymerization ratio of 87% as a white dispersion. (Latex grains described in JP-A-60-185963).

Dispersion-Stabilizing Resin (R-3)

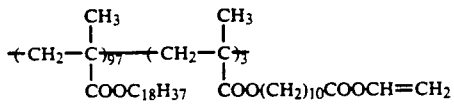

(weight composition ratio)

Weight average molecular weight: 46,000

SYNTHESIS EXAMPLE D-54

Synthesis of Latex Grain (D-54)

A mixture of 12 g of Dispersion-Stabilizing Resin (P-1), 100 g of vinyl acetate, 1.5 g of Compound IV-2-19 as Monomer (B-2), and 384 g of Isopar H was heated to 70° C. with stirring under nitrogen gas stream and, after adding 0.8 g of AIVN to the reaction mixture, the reaction was carried out for 6 hours. Twenty minutes after the addition of the polymerization initiator, the mixture became white turbid, and the reaction temperature raised to 88° C. The reaction mixture was then stirred for 2 hours at 100° C. to distill off the unreacted vinyl acetate. After cooling, the reaction mixture was passed through a 200 mesh nylon cloth to obtain the desired latex grains having a mean grain size of 0.20 μm with a polymerization ratio of 85% as a white dispersion.

SYNTHESIS EXAMPLES D-55 TO D-75

Synthesis of Latex Grains (D-55) to (D-75)

By following the same procedure as Synthesis Example D-54 except that each of the dispersion-stabilizing resins and each of the monomers (B-2) shown in Table 6 below were used in place of Dispersion-Stabilizing Resin (P-1) and Compound IV-2-19 as Monomer (B-2), respectively, each of the latex grains was produced. The polymerization ratios of the resulting grains were from 85% to 90%.

TABLE 6

| Synthesis Example No. | Latex Grain | Dispersion-Stabilizing Resin | Monomer (B-2) | Mean Grain Size of Latex (μm) |
|---|---|---|---|---|
| 55 | (D-55) | (P-1) | IV-2-1 | 0.19 |
| 56 | (D-56) | " | IV-2-2 | 0.19 |
| 57 | (D-57) | " | IV-2-3 | 0.20 |
| 58 | (D-58) | " | IV-2-8 | 0.22 |
| 59 | (D-59) | " | IV-2-9 | 0.22 |
| 60 | (D-60) | " | IV-2-10 | 0.20 |
| 61 | (D-61) | " | IV-2-11 | 0.18 |
| 62 | (D-62) | " | IV-2-14 | 0.17 |
| 63 | (D-63) | " | IV-2-18 | 0.21 |
| 64 | (D-64) | (P-2) | IV-2-10 | 0.19 |
| 65 | (D-65) | (P-3) | IV-2-19 | 0.20 |
| 66 | (D-66) | (P-4) | IV-2-20 | 0.22 |
| 67 | (D-67) | (P-5) | IV-2-21 | 0.22 |
| 68 | (D-68) | (P-10) | IV-2-22 | 0.23 |
| 69 | (D-69) | (P-12) | IV-2-23 | 0.23 |
| 70 | (D-70) | (P-15) | IV-2-24 | 0.22 |
| 71 | (D-71) | (P-16) | IV-2-15 | 0.23 |
| 72 | (D-72) | (P-17) | IV-2-16 | 0.18 |
| 73 | (D-73) | (P-18) | IV-2-26 | 0.19 |
| 74 | (D-74) | (P-13) | IV-2-27 | 0.20 |
| 75 | (D-75) | (P-12) | IV-2-29 | 0.21 |

SYNTHESIS EXAMPLE D-76

Synthesis of Latex Grain (D-76)

A mixture of 4 g (as solid component) of Dispersion-Stabilizing Resin (P-1), 7 g of poly(dodecyl methacrylate), 100 g of vinyl acetate, 1.5 g of Compound IV-2-15 as Monomer (B-2), and 380 g of n-decane was heated to 75° C. with stirring under nitrogen gas stream. After adding 1.0 g of AIBN to the reaction mixture, the reaction was carried out for 4 hours and, after further adding thereto 0.5 g of AIBN, the reaction was carried out for 2 hours. The reaction mixture was further stirred for 2 hours at 110° C. to distil off the low-boiling solvent and remaining vinyl acetate. After cooling, the reaction mixture was passed through a 200 mesh nylon cloth to obtain the desired latex grains having a mean grain size of 0.16 μm as a white dispersion.

SYNTHESIS EXAMPLE D-77

Synthesis of Latex Grain (D-77)

A mixture of 12 g of Dispersion-Stabilizing Resin (P-16), 85 g of vinyl acetate, 2.0 g of Compound IV-2-23 as Monomer (B-2), 15 g of N-vinylpyrrolidone, and 400 g of isododecane was heated to 65° C. with stirring under nitrogen gas stream and, after adding 1.5 g of AIBN to the reaction mixture, the reaction was carried out for 4 hours. After cooling, the reaction mixture was passed through a 200 mesh nylon cloth to obtain the desired latex grains having a mean grain size of 0.25 μm as a white dispersion.

SYNTHESIS EXAMPLE D-78

Synthesis of Latex Grain (D-78)

A mixture of 14 g of Dispersion-Stabilizing Resin (P-7), 100 g of vinyl acetate, 1.5 g of Compound IV-2-18 as Monomer (B-2), 5 g of 4-pentenoic acid, and 383 g of Isopar G was heated to 60° C. with stirring under nitrogen gas stream. After adding 1.0 g of AIVN to the reaction mixture, the reaction was carried out for 2 hours and, after further adding thereto 0.5 g of AIVN the reaction was carried out for 2 hours. After cooling, the reaction mixture was passed through a 200 mesh nylon cloth to obtain the desired latex grains having a mean grain size of 0.22 μm as a white dispersion.

SYNTHESIS EXAMPLE D-79

Synthesis of Latex Grain (D-79)

A mixture of 20 g of Dispersion-Stabilizing Resin (P-11), 2 g of Compound IV-2-16 as Monomer (B-2), 1 g of n-dodecylmercaptane, 100 g of methyl methacrylate, and 478 g of Isopar H was heated to 65° C. with stirring under nitrogen gas stream and, after adding 1.2 g of AIVN to the reaction mixture, the reaction was carried out for 4 hours. After cooling, the reaction mixture was passed through a 200 mesh nylon cloth to remove coarse grains, whereby the desired latex grains having a mean grain size of 0.2 μm were obtained as a white dispersion.

SYNTHESIS EXAMPLE D-80

Synthesis of Latex Grain (D-80)

A mixture of 20 g of Dispersion-Stabilizing Resin (P-6), 100 g of styrene, 4 g of Compound IV-2-25 as Monomer (B-2), and 380 g of Isopar H was heated to 50° C. with stirring under nitrogen gas stream and, after adding 1.0 g (as solid component) of a hexane solution of n-butyl lithium to the reaction mixture, the reaction was carried out for 4 hours. After cooling, the reaction mixture was passed through a 200 mesh nylon cloth to obtain the desired latex grains having a mean grain size of 0.24 μm as a white dispersion.

SYNTHESIS EXAMPLE D-81

Synthesis of Latex Grain for Comparison (A-3)

By following the same procedure as Synthesis Example D-54 except for using a mixture of 16 g of copolymer of octadecyl methacrylate and methacrylic acid (95/5 by weight ratio), 100 g of vinyl acetate, 1.5 g of Compound IV-2-19 as Monomer (B-2), and 380 g of Isopar H, latex grains having a mean grain size of 0.23 μm were obtained with a polymerization ratio of 88% as a white dispersion. (Latex grains described in JP-A-62-151868).

SYNTHESIS EXAMPLE D-82

Synthesis of Latex Grain for Comparison (B-3)

By following the same procedure as Synthesis Example D-54 except for using a mixture of 14 g of the dispersion-stabilizing resin having the chemical structure shown below, 100 g of vinyl acetate, 1.5 g of Compound IV-2-19 as Monomer (B-2), and 386 g of Isopar H, latex grains having a mean grain size of 0.25 μm were obtained with a polymerization ratio of 90% as a white dispersion. (Latex grains described in JP-A-63-66567).

Dispersion-Stabilizing Resin

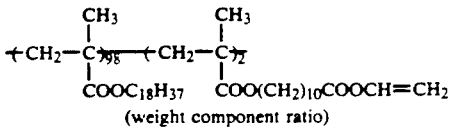

(weight component ratio)

Weight average molecular weight: 43,000

EXAMPLE 1

In a paint shaker (manufactured by Tokyo Seiki K.K.) were placed 10 g of a dodecyl methacrylate/acrylic acid copolymer (95/5 by weight ratio), 10 g of nigrosine, and 30 g of Shellsol 71 together with glass beads followed by dispersing for 4 hours to prepare a fine dispersion of nigrosine.

Then, a liquid developer for electrostatic photography was prepared by diluting 30 g of Latex Grain D-1 obtained in Synthesis Example D-1 (resin dispersion), 2.5 g of the above described nigrosine dispersion, 15 g of FOC-1400 (trade name of tetradecyl alcohol, made by Nissan Chemical Industries, Ltd.), and 0.08 g of a copolymer of octadecene and semi-maleic octadecylamide with one liter of Shellsol 71.

Comparison Liquid Developers A-1, B-1, and C-1

Three kinds of comparison developers A-1, B-1, and C-1 were prepared in the same manner as above except that each of the resin dispersions shown below was used in place of the above described resin dispersion, respectively.

Comparison Liquid Developer A-1

The resin dispersion obtained in Synthesis Example D-25 (Latex Grain for Comparison (A-1)) was used.

Comparison Liquid Developer B-1

The resin dispersion obtained in Synthesis Example D-26 (Latex Grain for Comparison (B-1)) was used.

Comparison Liquid Developer C-1

The resin dispersion obtained in Synthesis Example D-27 (Latex Grain for Comparison (C-1)) was used.

An electrophotographic light-sensitive material, ELP Master II Type (trade name, made by Fuji Photo Film, Co., Ltd.) was image-exposed and developed by a full-automatic processor, ELP 404V (trade name, made by Fuji Photo Film Co., Ltd.) using each of the liquid developers thus prepared. The processing (plate-making) speed was 5 plates per minute. Furthermore, after processing 2,000 plates of ELP Master II Type, the occurrence of stains of the developing apparatus by sticking of the toner was observed. The blackened ratio (imaged area) of the duplicated images was determined using 20% original. The results obtained are shown in Table 7 below.

TABLE 7

| Test No. | Liquid Developer | Stains of Developing Apparatus | Image of the 2,000th Plate | Printing Durability (Number of Prints) |
|---|---|---|---|---|
| 1 | Developer of Example 1 | No toner residue | Clear | 10,000 or more |
| 2 | Comparison Developer A-1 | Severe toner residue | Cut of letters, Decreased density of solid black portion, Background fog. | 10,000 or more |
| 3 | Comparison Developer B-1 | Slight toner residue | Slight scratches of fine lines, decreased $D_{max}$. | 7,000 |
| 4 | Comparison Developer C-1 | Slight toner residue | Slight scratches of fine lines, decreased $D_{max}$. | 9,000 |

As is clear from the results shown above, when printing plates were produced by the above described processing condition using each liquid developer, only liquid developer which caused no stains of the developing apparatus and gave clear image on the 2,000th plate was the liquid developer of the present invention.

Then, the offset printing master plate (ELP master) prepared by processing using each of the liquid developers was used for printing in a conventional manner, and the number of prints obtained before occurrence of defects of letters on the images of the print, or the decrease in the density of the solid black portions of the images was checked. The results showed that the master plate obtained by using each of the liquid developer of the present invention and Comparison Liquid Developer A-1 gave 10,000 prints or more without accompanied by the above described failures, while the master plate prepared using Comparison Liquid Developer B-1 caused the failures after making 7,000 plates, and the master plate obtained using Comparison Liquid Developer C-1 caused the failures after making 9,000 plates.

As is clear from the results above, only the liquid developer according to the present invention could give a greatly increased print number by the printing master plate without causing stains of the developing apparatus.

Specifically, in the case of using Comparison Liquid Developer A-1, there was no problem on the number of prints obtained, but the developing apparatus was too stained to be further used continuously.

Also, in the cases of using each of Comparison Liquid Developer B-1 and Comparison Liquid Developer C-1, the developing apparatus (in particular, the back electrode) was stained when the developer was used under the condition of a rapid processing speed of 5 plates/minutes (an ordinary processing speed was 2 or 3 plates/minutes) and, after making 2,000 plates, the image quality of the duplicated images on the plate was degradated (the decrease of $D_{max}$, scratches of fine lines, etc.). The number of prints by the master plate in the case of using Comparison Liquid Developer C-1 was decreased 10% or more as compared with the case of using the liquid developer of the present invention, and the number of prints in the case of using Comparison Liquid Developer B-1 was decreased 30% or more as compared with the case of using the liquid developer of the present invention.

These results indicates that the resin grains according to the present invention are clearly excellent.

EXAMPLE 2

A mixture of 100 g of the white dispersion obtained in Synthesis Example D-2 and 1.5 g of Sumikalon Black was heated to 100° C. and stirred for 4 hours. After cooling to room temperature, the reaction mixture was passed through a 200 mesh nylon cloth to remove the remaining dye to obtain a black resin dispersion having a mean grain size of 0.25 μm.

Then, a liquid developer was prepared by diluting 32 g of the above described black resin dispersion, 20 g of FOC-1600 (trade name of hexadecyl alcohol, made by Nissan Chemical Industries, Ltd.), and 0.05 g of zirconium naphthenate with one liter of Shellsol 71.

The liquid developer thus prepared was applied to the same developing apparatus as used in Example 1, and no occurrence of stains of the developing apparatus by sticking of the toner was observed even after developing 2,000 plates.

Also, the image quality of the offset printing master plate obtained was clear, and the image quality of the 10,000th print obtained using the printing plate was very clear.

EXAMPLE 3

A mixture of 100 g of the white dispersion obtained in Synthesis Example D-21 and 3 g of Victoria Blue B was heated to a temperature of from 70° C. to 80° C. and stirred for 6 hours. After cooling to room temperature, the reaction mixture was passed through a 200 mesh nylon cloth to remove the remaining dye to obtain a blue resin dispersion having a mean grain size of 0.25 μm.

Then, a liquid developer was prepared by diluting 32 g of the above described blue resin dispersion and 0.05 g of zirconium naphthenate with one liter of Isopar H.

The resulting liquid developer was applied to the same developing apparatus as used in Example 1, no occurrence of stains of the developing apparatus by sticking of the toner was observed even after developing 2,000 plates. Also, the image quality of the offset printing master plate obtained was clear, and the image quality of the 10,000th print obtained using the printing plate was very clear.

EXAMPLE 4

A liquid developer was prepared by diluting 32 g of the white resin dispersion obtained in Synthesis Example D-2, 2.5 g of the nigrosine dispersion obtained in Example 1, 15 g of FOC-1800 (trade name of octadecyl alcohol, made by Nissan Chemical Industries, Ltd.), and 0.02 g of a semi-docosanylamidated product of a copolymer of diisobutylene and maleic anhydride with one liter of Isopar G.

The resulting liquid developer was applied to the same developing apparatus as in Example 1, no occurrence of stains of the developing apparatus by sticking of the toner was observed even after developing 2,000 plates. Also, the image quality of the offset printing master plate obtained and the image quality of the 10,000th print obtained using the master plate were very clear.

Furthermore, when the same processing as above was conducted after allowing to stand the liquid developer for 3 months, the same results as above were obtained.

EXAMPLE 5

In a paint shaker were placed 10 g of poly(decyl methacrylate), 30 g of Isopar H, and 8 g of Alkali Blue together with glass beads followed by dispersing for 2 hours to prepare a fine dispersion of Alkali Blue.

Then, a liquid developer was prepared by diluting 30 g of the white resin dispersion of Latex Grain (D-3) obtained in Synthesis Example D-3, 4.2 g of the above described Alkali Blue dispersion, and 0.06 g of a semi-docosanylamidated product of a copolymer of diisobutylene and maleic anhydride with one liter of Isopar G.

The resulting liquid developer was applied to the same developing apparatus as used in Example 1, and no occurrence of stains of the developing apparatus by sticking of the toner was observed even after developing 2,000 prints. Also, the image quality of the offset printing master plate obtained and the image quality of the 10,000th print obtained using the master plate were very clear.

EXAMPLES 6 TO 16

Each of liquid developers was prepared by following the same procedure as described in Example 5 except that each of the latexes shown in Table 8 below was used in place of the white resin dispersion of Latex Grain (D-3) used in Example 5.

TABLE 8

| Example | Latex Grains |
|---|---|
| 6 | (D-4) |
| 7 | (D-5) |
| 8 | (D-6) |
| 9 | (D-8) |
| 10 | (D-9) |
| 11 | (D-12) |
| 12 | (D-13) |
| 13 | (D-15) |
| 14 | (D-16) |
| 15 | (D-17) |
| 16 | (D-19) |

Each of the liquid developers thus prepared was applied to the same developing apparatus as used in Example 1, no occurrence of stains of the developing apparatus by sticking of the toner was observed even after developing 2,000 plates. Also, the image quality of the offset printing master plates obtained and the image quality of the 10,000th print obtained using each of the master plates were very clear.

Furthermore, when the same processing as above was conducted after allowing to stand each liquid developer for 3 months, the same results as above were obtained.

EXAMPLE 17

In a paint shaker (manufactured by Tokyo Seiki K.K.) were placed 10 g of a dodecyl methacrylate/acrylic acid copolymer (95/5 by weight ratio), 10 g of nigrosine, and 30 g of Isopar G together with glass beads followed by dispersing for 4 hours to prepare a fine dispersion of nigrosine.

Then, a liquid developer for electrostatic photography was prepared by diluting 30 g of the resin dispersion obtained in Synthesis Example D-28, 2.5 g of the above described nigrosine dispersion, 0.07 g of a copolymer of octadecene and semi-maleic octadecylamide, and 15 g of a higher alcohol, FOC-1600 (trade name, made by Nissan Chemical Industries, Ltd.) with one liter of Isopar G.

Comparison Liquid Developers A-2, B-2, and C-2

Three kinds of comparison liquid developers A-2, B-2, and C-2 were prepared in the same manner as above except for using the following resin dispersions in place of the resin dispersion described above, respectively.

Comparison Liquid Developer A-2

The resin dispersion obtained in Synthesis Example D-51 was used.

Comparison Liquid Developer B-2

The resin dispersion obtained in Synthesis Example D-52 was used.

Comparison Liquid Developer C-2

The resin dispersion obtained in Synthesis Example D-53 was used.

An electrophotographic light-sensitive material, ELP Master II Type (trade name, made by Fuji Photo Film Co., Ltd.) was image exposed and developed by a full-automatic processor, ELP 404V (trade name, made by Fuji Photo Film Co., Ltd.) using each of the liquid developers thus prepared. The processing speed (plate making speed) was 7 plates per minute. Further, the occurrence of stains of the developing apparatus by sticking of the toner after processing 3,000 ELP Master II Type plates was evaluated. The blackened ratio (imaged area) of the duplicated image was determined using 30% original.

The results obtained are shown in Table 9 below.

TABLE 9

| Test No | Liquid Developer | Stains of Developing Apparatus | Image of the 3,000th Plate |
|---|---|---|---|
| 1 | Developer of Example 17 | No stain | Clear |
| 2 | Comparison Developer A-2 | Severe toner residue | Cut of letters, Decreased density of solid black portion, Background fog. |
| 3 | Comparison Developer B-2 | Slight toner residue | Decreased density of solid black portion |
| 4 | Comparison Developer C-2 | " | Clear |

As is clear from the results shown in Table 9 above, when each of the liquid developers was used for making printing plates under the above described severe plate-making condition of very fast plate-making speed, only the liquid developer according to the present invention could provide the 3,000th plate having clear images without staining the developing apparatus.

Then, the offset printing master plate (ELP master) prepared by processing using each of the liquid developers was used for printing in a conventional manner, and the number of prints obtained before occurrences of defects of letters on the images of the print, or the decrease in the density of the solid black portions of the images was evaluated. The results showed that the master plate obtained using each of the liquid developer of the present invention and Comparison Liquid Developers A-2, B-2, and C-2 gave more than 10,000 prints without accompanied by the above described failures.

As is apparent from the results above, only the liquid developer prepared by using the resin grains according to the present invention could advantageously be used for preparing a large number of printing master plates without staining the developing apparatus.

Specifically, in the cases of using Comparison Liquid Developers A-2, B-2, and C-2, there was no problem on the number of prints but the developing apparatus was too stained to be further used in succession.

Also, in the case of using each of Comparison Liquid Developers B-2 and C-2, staining of the developing apparatus was greatly reduced as compared to the case of using Comparison Liquid Developer A-2 but the improvement was not satisfactory when the developing condition became severe.

More specifically, known Dispersion-Stabilizing Resin (R-2) used for Comparison Liquid Developer B-2 has the feature that the resin is a random copolymer containing Monomer (A) (vinyl acetate in the example) and a component having a polymerizable double bond group copolymerizing with Monomer (A), wherein the polymerizable double bond group exists in a portion near the polymer main chain, thereby the resin is considered to be inferior in the re-dispersibility of latex grains as compared with the dispersion-stabilizing resin of the present invention.

Also, known Dispersion-Stabilizing Resin (R-3) used for Comparison Liquid Developer C-2 has the chemical structure that the total sum of the atoms of the linkage group which links the polymerizable double bond group in the resin, which is copolymerized with Monomer (A), to the polymer main chain of the resin is at least 9 and further as compared to that the polymerizable double bond group in Comparison Liquid Developer B-2 has a structure of $$CH_2{=}\overset{\overset{\displaystyle CH_3}{|}}{C}{-}COO,$$

the structure of the polymerizable double bond group in Comparison Liquid Developer C-2 is $CH_2{=}CH{-}OCO{-}$ and has preferably good reactivity with vinyl acetate (Monomer (A)). Thus, in the case of using Comparison Liquid Developer C-2, the images of the 3,000th printing plate was clear and was greatly improved as compared with the case of using Comparison Liquid Developer B-2. However, in the case of using Comparison Liquid Developer C-2, the developing apparatus is yet stained by sticking of the toner when the developing condition becomes severe.

EXAMPLE 18

A mixture of 100 g of the white resin dispersion obtained in Synthesis Example D-28 and 1.5 g of Sumikalon Black was stirred for 4 hours at 100° C. After cooling to room temperature, the reaction mixture was passed through a 200 mesh nylon cloth to remove the remaining dye to obtain a black resin dispersion having a mean grain size of 0.25 μm.

Then, a liquid developer was prepared by diluting 30 g of the above described black resin dispersion, 0.05 g of zirconium naphthenate, and 20 g of FOC-1600 (trade name, made by Nissan Chemical Industries, Ltd.) with one liter of Shellsol 71.

The resulting liquid developer was applied to the same developing apparatus as in Example 17, and no occurrence of stains of the developing apparatus by sticking of the toner was observed even after developing 3,000 plates.

Also, the image quality of the offset printing master plate obtained was clear, and the image quality of the 10,000th print obtained using the printing plate was very clear.

EXAMPLE 19

A mixture of 100 g of the white resin dispersion obtained in Synthesis Example D-48 and 3 g of Victoria Blue was stirred for 6 hours at temperature of from 70° C. to 80° C. After cooling to room temperature, the reaction mixture was passed through a 200 mesh nylon cloth to remove the remaining dye to obtain a blue resin dispersion having a mean grain size of 0.25 μm was obtained.

Then, a liquid developer was prepared by diluting 32 g of the above described blue resin dispersion, 0.05 g of zirconium naphthenate, and 15 g of FOC-1400 (trade name, made by Nissan Chemical Industries, Ltd.) with one liter of Isopar H.

The resulting liquid developer was applied to the same developing apparatus as in Example 17, and no occurrence of stains of the developing apparatus by sticking of the toner was observed even after developing 3,000 plates.

Also, the image quality of the offset printing master plate obtained was clear, and the image quality of the 10,000th print obtained using the printing plate was very clear.

Furthermore, when after allowing the liquid developer to stand for 3 months, the same processing was performed using the liquid developer, the same results as above were obtained.

EXAMPLE 20

In a paint shaker were placed 10 g of poly(decyl methacrylate), 30 g of Isopar H, and 8 g of Alkali Blue together with glass beads followed by dispersing for 2 hours to prepare a fine dispersion of Alkali Blue.

Then, a liquid developer was prepared by diluting 30 g of the white resin dispersion obtained in Synthesis Example D-28, 4.2 g of the above described Alkali Blue dispersion, 15 g of a higher alcohol, FOC-1400 (trade name, made by Nissan chemical Industries, Ltd.), and 0.06 g of a semidocosanylamidated product of a copolymer of isobutylene and maleic anhydride with one liter of Isopar G.

The resulting liquid developer was applied to the same developing apparatus as in Example 17, and no occurrence of stains of the developing apparatus by sticking of the toner was observed even after developing 3,000 plates. Also, the image quality of the offset printing master plate obtained and the image quality of the 10,000th print obtained using the printing plate were very clear.

EXAMPLES 21 TO 37

Each of liquid developers was prepared by following the same procedure as described in Example 20 except that 6.0 g (as solid component) of each of the latex grains shown in Table 10 below was used in place of the white resin dispersion obtained in Synthesis Example D-28.

TABLE 10

| Example | Latex Grain | Stains of Developing Apparatus | Image of the 3,000th Plate |
|---|---|---|---|
| 21 | (D-29) | No stains | Clear |
| 22 | (D-30) | " | " |
| 23 | (D-31) | " | " |
| 24 | (D-32) | " | " |
| 25 | (D-33) | " | " |
| 26 | (D-34) | " | " |
| 27 | (D-35) | " | " |
| 28 | (D-36) | " | " |
| 29 | (D-37) | " | " |
| 30 | (D-38) | " | " |
| 31 | (D-39) | " | " |
| 32 | (D-40) | " | " |
| 33 | (D-41) | " | " |
| 34 | (D-42) | " | " |

TABLE 10-continued

| Example | Latex Grain | Stains of Developing Apparatus | Image of the 3,000th Plate |
|---|---|---|---|
| 35 | (D-43) | " | " |
| 36 | (D-44) | " | " |
| 37 | (D-45) | " | " |

Each of the liquid developers thus prepared was applied to the same developing apparatus as in Example 17, and no occurrence of stains of the developing apparatus by sticking of the toner was observed even after developing 3,000 plates. Also, the image quality of the offset printing master plate obtained and the image quality of the 10,000th print obtained using each of the printing plates were very clear.

EXAMPLE 38

In a paint shaker (manufactured by Tokyo Seiki K.K.) were placed 10 g of a dodecyl methacrylate/acrylic acid copolymer (95/5 by weight ratio), 10 g of nigrosine, and 30 g of Isopar G together with glass beads followed by dispersing for 4 hours to prepare a fine dispersion of nigrosine.

Then, a liquid developer for electrostatic photography was prepared by diluting 30 g of the resin dispersion obtained in Synthesis Example D-54, 2.5 g of the above described nigrosine dispersion, 0.07 g of a copolymer of octadecene and semi-maleic octadecylamide, and 15 g of a higher alcohol, FOC-1600 (trade name, made by Nissan Chemical Industries, Ltd.) with one liter of Isopar G.

Comparison Liquid Developers A-3 and B-3

Two kinds of comparison liquid developers A-3 and B-3 were prepared in the same manner as described above except for using the following resin dispersions in place of the above described resin dispersion, respectively.

Comparison Liquid Developer A-3

The resin dispersion obtained in Synthesis Example D-81 was used.

Comparison Liquid Developer B-3

The resin dispersion obtained in Synthesis Example D-82 was used.

An electrophotographic light-sensitive material, ELP Master II Type (trade name, made by Fuji Photo Film Co., Ltd.) was image exposed and developed by a full-automatic processor, ELP 404V (trade name, made by Fuji Photo Film Co., Ltd.) using each of the liquid developers thus prepared. The processing speed (plate-making speed) was 6 plates per minute. Further, the occurrence of stains of the developing apparatus by sticking of the toner after processing 2,000 ELP Master II Type plates was evaluated. The blackened ratio (imaged area) of the duplicated image was determined using 30% original.

The results obtained are shown in Table 11 below.

TABLE 11

| Test No. | Liquid Developer | Stains of Developing Apparatus | Image of the 2,000th Plate |
|---|---|---|---|
| 1 | Developer of Example 38 | No stain | Clear |
| 2 | Comparison Developer A-3 | Severe toner residue. | Cut of letters, Decreased |

TABLE 11-continued

| Test No. | Liquid Developer | Stains of Developing Apparatus | Image of the 2,000th Plate |
|---|---|---|---|
| | | | density of solid black portion, Background fog. |
| 3 | Comparison Developer B-3 | Slight toner residue | Decreased density of solid black portion |

As is clear from the results shown in Table 11 above, when each of the liquid developers was used for making printing plates under the above described severe plate-making condition of very fast plate-making speed, only the liquid developer according to the present invention could provide the 2,000th plate having clear images without staining the developing apparatus.

Then, the offset printing master plate (ELP master) prepared by processing using each of the liquid developers was used for printing in a conventional manner, and the number of prints obtained before occurrences of defects of the letters on the images of the print, or the decrease in the density of the solid black portions of the images were observed. The results showed that the master plate obtained using each of the liquid developer of the present invention and Comparison Liquid Developers A-3 and B-3 gave more than 10,000 prints without accompanied by the above described failures.

As is apparent from the results above, the only liquid developer prepared by using the resin grains according to the present invention could advantageously be used for preparing a large number of printing master plates without staining the developing apparatus.

Specifically, in the cases of using Comparison Liquid Developers A-3 and B-3, there was no problem on the number of prints but the developing apparatus was too stained to be further used in succession.

Also, in the case of using Comparison Liquid Developer B-3, staining of the developing apparatus was greatly reduced as compared to the case of using Comparison Liquid Developer A-3, but the improvement was not yet satisfactory when the developing condition became severe.

More specifically, known Dispersion-Stabilizing Resin used for Comparison Liquid Developer B-3 has the feature that the resin is a random copolymer containing Monomer (A) (vinyl acetate in the example) and a component having a polymerizable double bond group copolymerizing with Monomer (A), wherein the polymerizable double bond group exists in a portion near the polymer main chain, thereby the resin is considered to be inferior in the re-dispersibility of latex grains as compared with the dispersion-stabilizing resin of the present invention.

EXAMPLE 39

A mixture of 100 g of the white resin dispersion obtained in Synthesis Example D-54 and 1.5 g of Sumikalon Black was stirred for 4 hours at 100° C. After cooling to room temperature, the reaction mixture was passed through a 200 mesh nylon cloth to remove the remaining dye to obtain a black resin dispersion having a mean grain size of 0.25 μm.

Then, a liquid developer was prepared by diluting 30 g of the above described black resin dispersion, 0.05 g of zirconium naphthanate, and 20 g of FOC-1600 (trade name, made by Nissan Chemical Industries, Ltd.) with one liter of Shellsol 71.

The resulting liquid developer was applied to the same developing apparatus as used in Example 38, no occurrence of stains of the developing apparatus by sticking of the toner was observed even after developing 3,000 plates.

Also, the image quality of the offset printing master plate obtained was clear, and the image quality of the 10,000th print obtained using the printing plate was very clear.

EXAMPLE 40

A mixture of 100 g of the white resin dispersion obtained in Synthesis Example D-78 and 3 g of Victoria Blue B was stirred for 6 hours at temperature of from 70° C. to 80° C. After cooling to room temperature, the reaction mixture was passed through a 200 mesh nylon cloth to remove the remaining dye to obtain a blue resin dispersion having a mean grain size of 0.25 μm was obtained.

Then, a liquid developer was prepared by diluting 32 g of the above described blue resin dispersion, 0.05 g of zirconium naphthenate, and 15 g of FOC-1400 (trade name, made by Nissan chemical Industries, Ltd.) with one liter of Isopar H.

The resulting liquid developer was applied to the same developing apparatus as in Example 38, no occurrence of stains of the developing apparatus by sticking of the toner was observed even after developing 2,000 plates. Also, image quality of the offset printing master plate obtained was clear and the image quality of the 10,000th print obtained using the printing plate was very clear.

Furthermore, when the above described processing was performed after allowing to stand the liquid developer for 3 months, the same results as above were obtained.

EXAMPLE 41

In a paint shaker were placed 10 g of poly(decyl methacrylate), 30 g of Isopar H, and 8 g of Alkali Blue together with glass beads followed by dispersing to prepare a fine dispersion of Alkali Blue.

Then, a liquid developer was prepared by diluting 30 g of the white resin dispersion obtained in Synthesis Example D-54, 4.2 g of the above described Alkali Blue dispersion, 15 g of a higher alcohol, FOC-1400 (trade name, made by Nissan Chemical Industries, Ltd.), and 0.06 g of a semi-docasanylamidated compound of a copolymer of diisobutylene and maleic anhydride with one liter of Isopar G.

The resulting liquid developer was applied to the same developing apparatus as in Example 38, and no occurrence of stains of the developing apparatus by sticking of the toner even after developing 2,000 plates. Also, the image quality of the offset printing master plate obtained and image quality of the 10,000th print obtained using the printing plate were very clear.

EXAMPLES 42 TO 58

Each of liquid developers was prepared by following the same procedure as described in Example 41 except that 6.0 g (as solid component) of each of the latex grains shown in Table 12 below was used in place of the white resin dispersion obtained in Synthesis Example D-54.

TABLE 12

| Example | Latex Grain | Stains of Developing Apparatus | Image of the 3,000th Plate |
|---|---|---|---|
| 42 | (D-55) | No stains | Clear |
| 43 | (D-56) | " | " |
| 44 | (D-57) | " | " |
| 45 | (D-58) | " | " |
| 46 | (D-59) | " | " |
| 47 | (D-60) | " | " |
| 48 | (D-61) | " | " |
| 49 | (D-62) | " | " |
| 50 | (D-63) | " | " |
| 51 | (D-64) | " | " |
| 52 | (D-65) | " | " |
| 53 | (D-66) | " | " |
| 54 | (D-67) | " | " |
| 55 | (D-68) | " | " |
| 56 | (D-69) | " | " |
| 57 | (D-70) | " | " |
| 58 | (D-71) | " | " |

Each of the liquid developers thus obtained was applied to the same developing apparatus as used in Example 38, and no occurrence of stains of the developing apparatus by sticking of the toner was observed. Also, the image quality of the offset printing master plates obtained and the image quality of the 10,000th print obtained using each of the printing plates were very clear.

As described hereinafter, in accordance with the present invention, a liquid developer for electrostatic photography which is excellent in dispersion stability, re-dispersibility and fixability is obtained. In particular, when the liquid developer is employed under severe plate-making condition of high plate-making speed, no stain occurs on the developing apparatus and the maintenance interval of the developing apparatus can be prolonged. Further, the image quality of the offset printing master plate obtained and the image quality of the 10,000 print obtained using the printing plate are very clear.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography which comprises resin grains dispersed in a non-aqueous solvent having an electric resistance of at least $10^9\ \Omega$ cm and a dielectric constant of not higher than 3.5, wherein the dispersed resin grains are copolymer resin grains obtained by polymerizing a solution containing at least one kind of a mono-functional monomer (A) which is soluble in the non-aqueous solvent but becomes insoluble in the non-aqueous solvent by being polymerized, in the presence of a dispersion-stabilizing resin which is soluble in the non-aqueous solvent and is a comb-like copolymer comprising at least (1) a mono-functional macromonomer (M) having a weight average molecular weight of from $1\times10^3$ to $2\times10^4$ and (2) a monomer represented by the general formula (III) described below, the mono-functional macromonomer (M) comprising at least one polymer component corresponding to a repeating unit represented by the general formula (IIa) or (IIb) described below and at least one polymer component containing at least one polar group selected from —COOH, $-PO_3H_2$, $-SO_3H$, —OH,

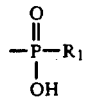

(wherein $R_1$ represents $-R_2$ or $-OR_2$ (wherein $R_2$ represents a hydrocarbon group)), —SH, a formyl group and an amino group, and the monofunctional macromonomer (M) having a polymerizable double bond group represented by the general formula (I) described below bonded to only one terminal of the main chain thereof;

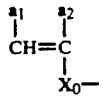

(I)

wherein $X_0$ represents —COO—, —OCO—, $-CH_2OCO-$, $-CH_2COO-$, or —O—, $-SO_2-$, —CO—

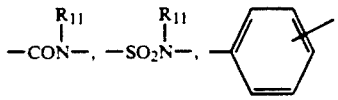

(wherein $R_{11}$ represents a hydrogen atom or a hydrocarbon group), and $a_1$ and $a_2$, which may be the same or different, each represents a hydrogen atom, a halogen atom, a cyano group, a hydrocarbon group, $-COO-Z_1$ or $-COO-Z_1$ bonded via a hydrocarbon group (wherein $Z_1$ represents a hydrogen atom or a hydrocarbon group);

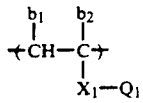

(IIa)

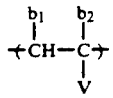

(IIb)

wherein $X_1$ has the same meaning as $X_0$ in the general formula (I); $Z_1$ represents an aliphatic group having from 1 to 22 carbon atoms or an aromatic group having from 6 to 12 carbon atoms; $b_1$ and $b_2$, which may be the same or different, have the same meaning as $a_1$ and $a_2$ in the general formula (I); and V represents —CN, $-CONH_2$, or

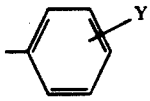

(wherein Y represents a hydrogen atom, a halogen atom, an alkoxy group or $-COOZ_2$ (wherein $Z_2$ represents an alkyl group, an aralkyl group, or an aryl group));

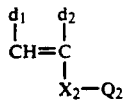

(III)

wherein $X_2$ has the same meaning as $X_0$ in the general formula (I); $Z_2$ has the same meaning as $Z_1$ in the general formula (IIa); and $d_1$ and $d_2$, which may be the same or different, have the same meaning as $a_1$ and $a_2$ in the general formula (I), with the proviso that, in the component of the mono-functional macromonomer (M) represented by the general formula (II) and in the component of the monomer represented by the general formula (III), at least one of $Q_1$ and $Q_2$ represents an aliphatic group having from 10 to 22 carbon atoms.

2. A liquid developer for electrostatic photography as claimed in claim 1, wherein the dispersion-stabilizing resin is a comb-like copolymer having a weight average molecular weight of from $2\times10^4$ to $2\times10^5$.

3. A liquid developer for electrostatic photography as claimed in claim 1, wherein the dispersion-stabilizing resin is a comb-like copolymer having a polar group selected from $-PO_3H_2$, $-SO_3H$, $-COOH$, $-OH$, $-SH$,

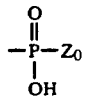

(wherein $Z_0$ represents $-Z_{10}$ or $-OZ_{10}$ (wherein $Z_{10}$ represents a hydrocarbon group)), a formyl group, and an amino group bonded only one terminal of the copolymer main chain.

4. A liquid developer for electrostatic photography as claimed in claim 1, wherein a content of the mono-functional macromonomer (M) in the comb-like copolymer is from 1 to 70% by weight based on the weight of the copolymer.

5. A liquid developer for electrostatic photography as claimed in claim 1, wherein a content of the polymerizable component containing at least one polar group in the mono-functional macromonomer (M) is from 0.5 to 50 parts by weight per 100 parts by weight of the total copolymerizable components of the macromonomer (M).

6. A liquid developer for electrostatic photography as claimed in claim 1, wherein the mono-functional monomer (A) is a monomer represented by the following general formula (V):

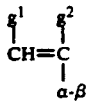

(V)

wherein α represents —COO—, OCO—, —CH$_2$OCO—, —CH$_2$COO—, —O—,

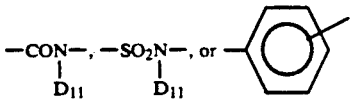

(wherein $D_{11}$ represents a hydrogen atom or an aliphatic group having from 1 to 18 carbon atoms which may be substituted; 8 represents a hydrogen atom or an aliphatic group having from 1 to 6 carbon atoms which may be substituted; and $g_1$ and $g_2$, which may be the same or different, each represents a hydrogen atom, a halogen atom, a cyano group, a hydrocarbon group having from 1 to 8 carbon atoms, —COO— $E_6$, or —COO—$E_6$ bonded via a hydrocarbon group having from 1 to 8 carbon atoms (wherein $E_6$ represents a hydrogen atom or a hydrocarbon group having from 1 to 18 carbon atoms.

7. A liquid developer for electrostatic photography as claimed in claim 1, wherein the solution containing the mono-functional monomer (A) further contains a monomer (B-1) represented by the following general formula (IV-1) which contains an aliphatic group having at least 8 carbon atoms and which is capable of forming a copolymer by copolymerization reaction with the mono-functional monomer (A);

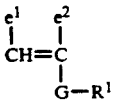

(IV-1)

wherein $R^1$ represents an aliphatic group having at least 8 carbon atoms; G represents —COO—, —CONH—,

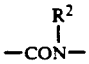

(wherein $R^2$ represents an aliphatic group), —OCO—, —CH$_2$COO— or —O—, and $e^1$ and $e^2$, which may be the same or different, each represents a hydrogen atom, an alkyl group, —COOR$^3$, or —CH$_2$—COOR$^3$ (wherein $R^3$ represents an aliphatic group).

8. A liquid developer for electrostatic photography as claimed in claim 7, wherein a content of the monomer (B-1) is from 0.1 to 20% by weight based on the amount of the monomer (A) used.

9. A liquid developer for electrostatic photography as claimed in claim 1, wherein the solution containing the mono-functional monomer (A) further contains a monomer (B-2) represented by the following general formula (IV-2) which contains at least two polar groups and/or polar linkage groups;

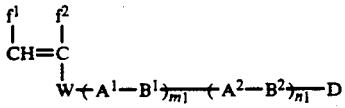

(IV-2)

wherein W represents —O—, —COO—, —OCO—, —CH$_2$OCO—, —SO$_2$—, —CONH, —SO$_2$NH—,

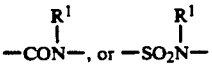

(wherein $R^1$ represents a hydrocarbon group or has the same meaning as the linkage group,

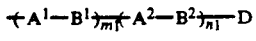

in the general formula (IV-2)); D represents a hydrogen atom or a hydrocarbon group having from 1 to 18 carbon atoms, which may be substituted with a halogen atom, —OH, —CN, $—NH_2$, —COOH, $—SO_3H$, or $—PO_3H_2$; $B^1$ and $B^2$, which may be the same or different, each represents —O—, —S—, —CO—, $—CO_2—$, —OCO—, $—SO_2—$, $$-\overset{R^2}{\overset{|}{N}}-,\ -\overset{R^2}{\overset{|}{C}}ON-,\ -\overset{R^2}{\overset{|}{N}}CO-,\ -\overset{R^2}{\overset{|}{N}}SO_2-,\ -SO_2\overset{R^2}{\overset{|}{N}}-,$$

$—NHCO_2$, or NHCONH— (wherein $R^2$ has the same meaning as D described above); $A^1$ and $A^2$, which may be the same or different, each represents a hydrocarbon group having from 1 to 18 carbon atoms, which may be substituted or may have a bond $$-\underset{\underset{B^3}{|}}{CH}-(A^4-B^4)_{p_1}-R^3$$

(wherein $B^3$ and $B^4$, which may be the same or different, have the same meaning as $B^1$ and $B^2$ described above; $A^4$ represents a hydrocarbon group having from 1 to 18 carbon atoms, which may be substituted; and $R^3$ has the same meaning as D described above); $f^1$ and $f^2$, which may be the same or different, each represents a hydrogen atom, a hydrocarbon group $—COO—R^4$, or $—COO—R^4$ bonded via a hydrocarbon group (wherein $R^4$ represents a hydrogen atom or a hydrocarbon group which may be substituted); and $m_1$, $n_1$, and $p_1$, which may be the same or different, each represents an integer of from 0 to 4, with the proviso that $m_1$, $n_1$, and $p_1$ cannot be 0 at the same time.

10. A liquid developer for electrostatic photography as claimed in claim 9, wherein a content of the monomer (B-2) is from 0.1 to 10% by weight based on the amount of the monomer (A) used.

11. A liquid developer for electrostatic photography as claimed in claim 1, wherein the liquid developer further contains a coloring agent.

* * * * *